US006972783B2

(12) United States Patent
Takamatsu et al.

(10) Patent No.: US 6,972,783 B2
(45) Date of Patent: Dec. 6, 2005

(54) METHOD AND APPARATUS FOR REDUCING THE VISIBILITY OF STREAKS IN IMAGES GENERATED USING SCANNING TECHNIQUES

(75) Inventors: Masahiro Takamatsu, Ashigarakami-gun (JP); Akira Ishii, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/409,165

(22) Filed: Apr. 9, 2003

(65) Prior Publication Data

US 2004/0056945 A1 Mar. 25, 2004

(30) Foreign Application Priority Data

Sep. 19, 2002 (JP) ..... 2002-273887

(51) Int. Cl.[7] ..... B41J 2/455
(52) U.S. Cl. ..... 347/233
(58) Field of Search ..... 347/233–237, 347/243, 246–250, 241, 251, 254; 359/204

(56) References Cited

U.S. PATENT DOCUMENTS 5,233,367 A * 8/1993 Curry ..... 347/243
5,748,223 A * 5/1998 Ito ..... 347/241
6,115,165 A * 9/2000 Tada ..... 359/204

FOREIGN PATENT DOCUMENTS

| | | |
|---|---|---|
| JP | A 4-149522 | 5/1992 |
| JP | A 4-149523 | 5/1992 |
| JP | A 4-149524 | 5/1992 |
| JP | A 5-42716 | 2/1993 |
| JP | A 8-292384 | 11/1996 |

OTHER PUBLICATIONS

Dooley et al., "Noise Perception in Electrophotography", Journal of Applied Photographic Engineering, vol. 5, No. 4, pp. 190-196, 1979.

* cited by examiner

*Primary Examiner*—Hai Pham
(74) *Attorney, Agent, or Firm*—Oliff & Berridge, PLC

(57) ABSTRACT

A plurality of beams scan the photosensitive body or the like so that a high quality image whose streak is not recognized by a human eye can be formed. 2m lines are formed simultaneously in Nth time, (N+1)-th time, and (N+2)-th time scannings respectively. At this point, the m lines are fed in a sub-scanning direction at each termination of one-time scanning, and the next scanning is performed. Accordingly, a region which is exposed twice between the scannings is generated at an m-line period.

24 Claims, 17 Drawing Sheets

○:COMBINATIONS OF m AND n WHICH SATISFY CONDITIONS OF INTERLACED SCANNING

| INTERLACED PERIOD (n) | | | | | | | | | |
|---|---|---|---|---|---|---|---|---|---|
| 9 | × | ○ | × | ○ | ○ | × | ○ | ○ | × |
| 8 | × | × | ○ | × | ○ | × | ○ | × | ○ |
| 7 | × | ○ | ○ | ○ | ○ | ○ | × | ○ | ○ |
| 6 | × | × | × | × | ○ | × | ○ | × | × |
| 5 | × | ○ | ○ | ○ | × | ○ | ○ | ○ | ○ |
| 4 | × | × | ○ | × | ○ | × | ○ | × | ○ |
| 3 | × | ○ | × | ○ | ○ | × | ○ | ○ | × |
| 2 | × | × | ○ | × | ○ | × | ○ | × | ○ |
| 1 | – | – | – | – | – | – | – | – | – |
| | 1 | 2 | 3 | 4 | 5 | 6 | 7 | 8 | 9 |

NUMBER OF BEAMS (m)

METHOD AND APPARATUS FOR REDUCING THE VISIBILITY OF STREAKS IN IMAGES GENERATED USING SCANNING TECHNIQUES

BACKGROUND OF THE INVENTION

1. Field of the Invention

The present invention relates to an image forming apparatus, particularly relates to an image forming apparatus such as a copying machine or a laser printer, in which a plurality of laser beams are scanned to form an image.

2. Description of the Related Art

In the image forming apparatus such as the copying machine or the laser printer, in which the laser beam scans a photosensitive body or the like to form the image, while high-speed and high-resolution proceed, the speedups of a rotational speed of a polygon mirror and a video clock are in a difficult state. Therefore, the speedup and the high-resolution are being attempted by increasing the number of light sources.

The image forming apparatus, in which a plurality of beams scans and exposes a scanned body such as a photosensitive body, have been applied to the patent. With reference to a scanning method, an adjacent scanning has been proposed to form a plurality of adjacent scanning lines with one main scanning, and a scanning method has been proposed to realize the high-resolution with an interlaced scanning which forms the plurality of scanning lines with a given distance in one main scanning.

FIG. 13 is an exploded perspective view showing a configuration of the image forming apparatus of the related art. In the image forming apparatus, as shown in FIG. 13, there has been realized one in which many beams are used to perform the light scanning by utilizing a semiconductor laser array 21 which is easy to form an array.

In the above-described image forming apparatus, constraints of an optical system are increased because a scanning width (the number of beams X the between the scanning lines) is widened on an image holding body 5 (photosensitive body) because of scanning the plurality of beams. Consequently, the adjacent scanning method is the easiest method to realize the laser scanning method.

However, when the number of beams is increased and the scanning width in a sub-scanning direction is widened in one main scanning, both a region where exposure is performed with one main scanning and a region where the exposure is performed with the two-time main scanning are generated.

FIG. 14 shows an exposure profile of the adjacent scanning method, which indicates exposure energy for a position in the sub-scanning direction.

According to FIG. 14, there are the region where the exposure is performed with one main scanning only and the region where the exposure is performed with the two-time main scanning. A change in characteristics of the photosensitive body is generated by presence of the regions with the different exposure state. Concretely, the image density is increased in the region where the exposure is performed with the two-time main scanning and a phenomenon which is observed as a streak is generated.

As concerns such phenomenon, it is known that, when a silver halide film is used as a recording material for the exposure performed with the many beams, the characteristics of the density are affected by reciprocity law, reciprocity law failure, and multiple exposure of a photosensitive material, the density is increased in the two-time scanning portion where an end portion of a laser beam group, which is a group of the plurality of beams, is overlapped on the photosensitive material by each of sub-scanning, and the image streak appears (for example, see Japanese Patent Application Laid-Open (JP-A) No. 4-149522 (Japanese Patent No. 2685345), JP-A No. 4-149523 (Japanese Patent No. 2628934), or JP-A No. 4-149524 (Japanese Patent No. 2685346)).

In the photosensitive body of an electrophotographic apparatus and the like, when the exposure is performed by the laser and the like as a light source, it is reported that charge/antistatic characteristics of the photosensitive body is varied by difference in exposure form, which is caused by the reciprocity law failure. For example, in the hi-speed scanning and exposure, more intense energy emitting is required than the light lens exposure.

For this problem, in the JP-A No. 5-42716, sensitivity of the photosensitive body is effectively increased with a method in which the two-time exposure forms one scanning line in a manner that scans the two beams with time shifting (hereinafter referred to as "double exposure").

For this phenomenon, in JP-A No. 4-149523, the image streak is eliminated by widening the space between the Nth time scanning and the (N+1)-th time scanning (the space of a joint) more than other spaces between the scannings, as shown in FIG. 5 of JP-A No. 4-149523. In JP-A No. 4-149522 (Japanese Patent No. 2685345), the image streak is eliminated in such a manner that light intensity of at least one of the mth beam in the m lines of light beams which performs the Nth time main scanning and the first beam in the beams which performs the (N+1)-th time main scanning is set to the different light intensity from that of other beams to perform the scanning and the exposure.

In JP-A No. 4-149524 (Japanese Patent No. 2685346), when the exposure of the mth beam in the m lines of light beams which performs the Nth time main scanning and the exposure of the first beam in the beams which performs the (N+1)-th time main scanning are overlapped, the light intensity of at least one of the first beam and the mth beam is changed, when one of the mth beam in the m lines of light beams which performs the Nth time main scanning and the first beam in the beams which performs the (N+1) th time main scanning is used for the exposure and the other is not used for the exposure, the light intensity of the beam which is used for the exposure is maintained. Consequently, secondary failure caused by the change in the light intensity of the beam is prevented.

The one-time exposure region and the two-time exposure region will be described below by using FIG. 14. A horizontal axis in FIG. 14 is a moving direction of the photosensitive body (sub-scanning direction), and a vertical axis is the exposure energy which is given by the scanning exposure. The profile of a broken line is a exposure energy distribution when a batch scanning (adjacent scanning) is performed in scanning lines density of 2400 dpi with the 36 beams having a 50 $\mu$spot diameter (Nth time scanning). A dotted line is the exposure energy distribution caused by the (N+1)-th time scanning, the dotted line is shifted from the broken line the 36 scanning line of 2400 dpi (movement of the photosensitive body).

The exposure energy distribution of each scanning is substantially trapezoid-shaped. The region where the distribution is flat is the one-time exposure region where the entire exposure energy is applied in each scanning (one-time exposure). The region where the broken line region overlaps with the dotted line region is the two-time exposure region where the entire exposure energy is applied in two-time scanning. The two-time exposure region corresponds to an oblique line portion of FIG. 5 in the above-described JP-A No. 4-149523 (Japanese Patent No. 2628934).

In FIG. 5 of JP-A No. 4-149523, sum of the exposure energy distribution of the dotted line and that of the broken line are substantially the same (constant) in the one-time exposure region and the two-time exposure region. However, it was confirmed that the actual image density is higher in the two-time scanning region than in the one-time exposure region.

It is thought as a generating principle of the above-described phenomenon that recombination probability, in which positive and negative charges (electron/hole pair) generated by the exposure of the photosensitive body are recombined to eliminate the charge, is higher in the one-time exposure than in the two-time scanning. i.e., generated charge density is higher in the one-time exposure than in two-time scanning, and the charge quantity which finally discharges surface potential is higher in the two-time scanning than in the one-time exposure.

This corresponds qualitatively to the description of JP-A No. 5-42716, i.e., the double exposure effectively increases the sensitivity of the photosensitive body.

It is described in JP-A No. 4-149522 (Japanese Patent No. 2685345) that the image streak is eliminated in such a manner that light intensity of at least one of the mth beam in the m lines of light beams which performs the Nth time main scanning and the first beam in the beams which performs the (N+1)-th time main scanning is set to the different light intensity from that of other beams to perform the scanning and the exposure. According to the method, in the case of the image in which only one of the m beam in the Nth time and the first beam in the (N+1)-th time, because the reciprocity law failure is not generated, there is generated the problem that the image density is decreased corresponding to the decreased light intensity. Therefore, in JP-A No. 4-149524 (Japanese Patent No. 2685346), the problem is solved by changing the light intensity such that the light intensity of the beam is decreased or not decreased according to an image signal.

However, in the exposure apparatus having the multi beam scanning causing such a problem, it is difficult to implement an analogue circuit changing the light emitting quantity at high speed during referring to the image data for high speed and high resolution recording. An additional image memory or a processing circuit, which determines whether the light intensity is changed or not in each pixel, is also required. Further, there is the problem that a fast light intensity modulating circuit is also required in order to change the light intensity of the laser in each pixel according to the printing image. There is also the problem that it is necessary to change laser output largely, and the variable range of the laser output is large in order to decrease the image streak by adjusting the light intensity of the one laser (first or mth laser) or the two lasers (first and mth lasers) of the joint.

In JP-A No. 4-149523 (Japanese Patent No. 2628934), the speed of a galvanometer mirror is changed in order to change the intervals of the joint, however, according to the method, there is the problem that the image in the sub-scanning direction is expanded or contracted.

On the other hand, JP-A No. 5-42716, the double exposure in which the scanning line is formed with the two-time exposure is performed, in order to compensate the decrease in the sensitivity of the photosensitive body in the laser exposure. However, in the image forming apparatus described in JP-A No. 5-42716, the purpose of the apparatus is to solve shortage of the light intensity of the element, and there is the problem unevenness of the density is generated in the joint of the image when the number of beams is increased.

In the phenomenon in which the two-time scanning portion is recognized as the image streak because of the higher density of the two-time scanning region, the period of streak generation becomes an issue.

FIG. 15 shows VTF (Visual Transfer Function) of a human eye. VTF shown in FIG. 15 is known for image resolution of the human eye, which is described in Roger P Dooley and Rodney Shaw: "Noise perception in Electrophotography", Journal of Applied Photographic Engineering, Volume 5, Number 4, Fall 1979, p190–196.

JP-A No. 8-292384 says that it is difficult for the human eye to recognize the image having the spatial frequency higher than 4 lp (line pairs)/mm, according to VTH of the human eye.

In the exposure using the multiple elements in the related art, the number of laser elements is the utmost several elements, and it is not necessary to pay attention to the spatial frequency. For example, in the case that the number of beams is two and the resolution is 600 dpi, when the adjacent scanning is performed, the period of the streak generation is 300 dpi, it is about 11.8 lp/mm in terms of the spatial frequency, and the value is in the invisible range.

In the case that the interlaced scanning exposure is performed, since the adjacent scanning lines are formed by the different main scannings, the forming condition is almost equal in each scanning line. Therefore, it is thought that the streak is not generated. However, even in the case that the streak is generated, the period of the streak generation corresponds 600 dpi, the spatial frequency is 23.61 lp/mm, and the streak is invisible.

On a more strict view, in the adjacent scanning line affecting a certain scanning line, there are the case that the adjacent scanning line is previously formed and the case that the adjacent scanning line is subsequently formed for the subject scanning line. Taking this point into consideration, even if there is the difference in the density in which the streak is generated, the period of the streak generation corresponds 300 dpi, it is about 11.8 lp/mm in terms of the spatial frequency, and, similarly to the adjacent scanning, the streak is invisible.

However, when the scanning lines having the 2400 dpi scanning density are batch-scanned (adjacent scanning) by, e.g., 36 beams, the scanning space between the Nth time scanning and the (N+1)-th time scanning is 0.381 mm, and it is about 2.6 lp/mm in terms of the spatial frequency. The value of 2.6 lp/mm is in the range where the visibility is high and the scanning space is observed as the streak expanded in the main scanning direction, so that the image streak of the two-time scanning portion is recognized by the human eye.

SUMMARY OF THE INVENTION

In view of the foregoing, it is an object of the present invention to provide an image forming apparatus in which the plurality of beams scans so as to be able to form the high quality image whose image streak is not recognized by the human eye.

To this end, the present invention provides an image forming apparatus, which comprises a laser array having m light emitting elements in a sub-scanning direction, a data shifting unit for outputting m lines of image data in the sub-scanning direction for one main scanning period, subsequently reading image data which is a subject of a next output with the image data shifted by n (which is a divisor of m) lines in the sub-scanning direction, and repeating the same, a driving unit for driving each light emitting element of said laser array so as to emit a beam, on the basis of the image data which has been outputted from said data shifting unit, and a scanning unit for causing the beams which are emitted from said laser array to scan in a main scanning direction for said one main scanning period, subsequently moving a scanning start position for a next one main scanning period by said n lines in the sub-scanning direction, and repeating the same.

Since the (m/n)-time exposures are performed per one line, the light intensity of the laser can be largely decreased in one main scanning, and the change in the density, which is generated in the joint of the scanning, can be decreased. Further, since the multiple exposures are performed per one line and the amount of movement in the sub-scanning direction is decreased in each one main scanning period, the period of the streak generation in the image becomes n times, which causes the spatial frequency to increase. Consequently, the visibility of the streak can be decreased. Also, because the determination or control is not performed about the particular elements of the laser array, the complexity of the light intensity controlling circuit can be prevented.

In an embodiment, the present invention provides image forming apparatus further comprises an operational mode setting unit for setting a value of said n lines for said data shifting unit and said scanning unit according to an operational mode.

Since the value of the n lines is set according to the operational mode, the number of exposures (m/n) per one line can be changed, and the degree of freedom of the image formation can be increased. In the case of m=n, the adjacent scanning can be performed.

For example, as operational modes, there are a monochrome mode forming the monochrome image and a color mode forming the color image. In this case, the value of the n lines in the color mode should be set smaller than that in the monochrome mode. As a result, the number of exposure times per one line is larger in the color mode than in the monochrome mode, so that the high quality image can be obtained. On the other hand, the number of exposure times per one line is lower in the monochrome mode than in the color mode, so that the image forming speed can be increased.

In another embodiment, the present invention provides an image forming apparatus which comprises a laser array having 2m light emitting elements in a sub-scanning direction, a data arranging unit for outputting 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period, a driving unit for driving each light emitting element of said laser array so as to emit a beam, on the basis of the image data which has been outputted from said data shifting unit, a scanning unit for causing the beams which are emitted from said laser array to scan in a main scanning direction for said one main scanning period, subsequently moving a scanning start position for a next one main scanning period by said m lines in the sub-scanning direction, and repeating the same.

Substantial evenness of the exposure conditions of each scanning line can suppress the generation of the image streak in such a manner that the emitted element is changed in each scanning to perform the interlaced scanning. Further, since it is not necessary to change the optical system for the case in which the adjacent scanning is performed, the degree of freedom is not decreased for the optical design.

In a further embodiment, the present invention provides an image forming apparatus which further comprises an operational mode setting unit for setting a first or second operational mode, wherein when the first operational mode is set, said data arranging unit outputs 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period, and when the second operational mode is set, said data arranging unit outputs 2m lines of image data for each one main scanning period, and when the first operational mode is set, said scanning unit causes the beams which are emitted from said laser array to scan in a main scanning direction for said one main scanning period, subsequently moves a scanning start position for a next one main scanning period by said m lines in the sub-scanning direction, and repeats the same, and when the second operational mode is set, said scanning unit causes the beams which are emitted from said laser array to scan in a main scanning direction for said one main scanning period, subsequently moves a scanning start position for a next one main scanning period by said 2m lines in the sub-scanning direction, and repeats the same.

Since the interlaced scanning is performed in the case of the first operational mode and the adjacent scanning is performed in the case of the second operational mode, the degree of freedom of the image forming can be increased.

In a still further embodiment, the present invention provides an image forming apparatus which comprises an operational mode setting unit for setting a first or a second operational mode, a laser array having 2m light emitting elements in a sub-scanning direction, a data outputting unit for outputting 2m lines of image data in the sub-scanning direction for one main scanning period, subsequently shifting image data which is a subject of a next output by n (which is a divisor of 2m) lines in the sub-scanning direction, and repeating the same, when the first operational mode is set, and outputting 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period, when the second operational mode is set, a driving unit for driving each light emitting element of said laser array so as to emit a beam, on the basis of the image data which has been outputted from said data outputting unit, and a scanning unit for causing the beams which are emitted from said laser array to scan in a main scanning direction for said one main scanning period, subsequently moving a scanning start position for a next one main scanning period by said n lines in the sub-scanning direction, and repeating the same, when the first operational mode is set, and for causing the beams which are emitted from said laser array to scan in a main scanning direction for said one main scanning period, subsequently moving a scanning start position for a next one main scanning period by said m lines in the sub-scanning direction, and repeating the same, when the second operational mode is set.

The multiple scannings are performed per one line in the case of the first operational mode and the interlaced scanning is performed in the case of the second operational mode, so that the degree of freedom of the image forming can be increased.

DESCRIPTION OF THE PREFERRED EMBODIMENTS

Figure 1:
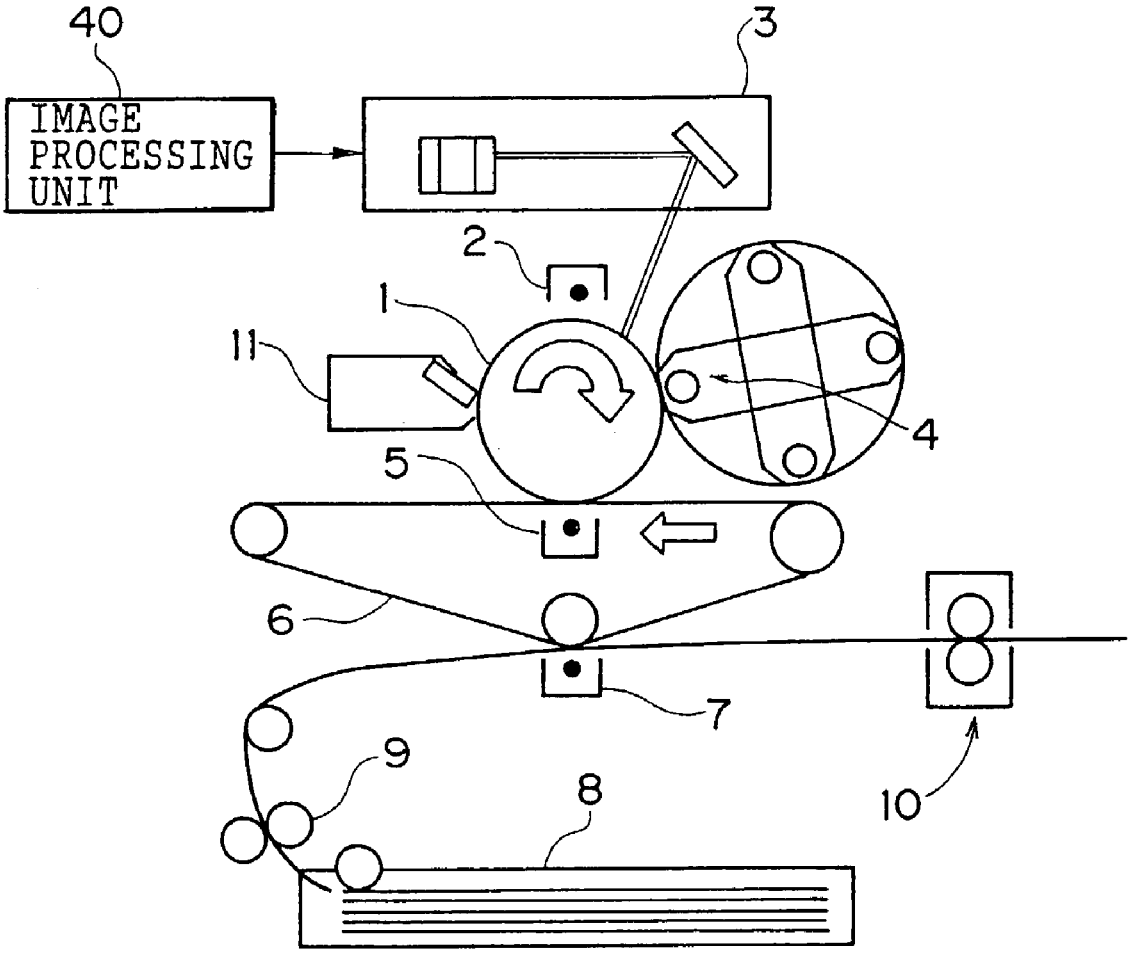
FIG. 1 shows a configuration of a color image forming apparatus according to a first embodiment, which utilizes an electrophotographic process.

Preferred embodiments of the present invention will be described in detail below referring to the drawings.

(First Embodiment)

FIG. 1 shows a configuration of a color image forming apparatus according to a first embodiment, which utilizes an electrophotographic process.

The color image forming apparatus according to the embodiment includes a photosensitive body 1 rotating in an arrow direction, a charging device 2 charging a surface of the photosensitive body 1, an exposure device 3 exposing the surface of the photosensitive body 1, a developing device 4 performing the development with toner, a primary transfer device 5 performing the primary transfer of a toner image, an intermediate transfer belt 6 to which the toner image is transferred by the primary transfer device 5, a secondary transfer device 7 transferring the toner image of the intermediate transfer belt 6 to the paper, a paper tray 8 storing the paper, a paper carrying roller 9 carrying the paper in a given direction, a fixing device 10 melting and fixing the toner image, a cleaning device 11 removing the residual toner, and an image processing unit 40 generating data for driving a vertical-cavity surface-emitting laser array 12 described later on the basis of image data.

The charging device 2 charges the surface of the photosensitive body 1. In the surface of the charged photosensitive body 1, the exposure device 3 selectively exposes an image portion or a background portion to generate an electrostatic latent image. The developing device 4 visualizes the electrostatic latent image with the toner to form the toner image. The primary transfer device 5 transfers the toner image formed on the photosensitive body 1 onto the intermediate transfer belt 6.

The secondary transfer device 7 transfers the toner image on the intermediate transfer belt 6 onto the paper which is carried from the paper tray 8 by the paper carrying roller 9 and the like. The fixing device 10 melts and fixes the toner image which is transferred to the paper. After the primary transfer, the cleaning device 11 recovers the residual toner from the surface of the photosensitive body 1.

The color image forming apparatus forms the full color image in a manner that performs an iteration of charge/exposure/development/primary transfer for each of Y (yellow), M (magenta), C (cyan), and K (black). At this point, the developing device 4 changes the color of the toner for the development by a 90 degrees rotation at each cycle.

The toner images of four colors are superimposed on the intermediate transfer belt 6. Accordingly, the paper carrying roller 9 never carries the paper to the secondary transfer device 7 until the image formation of the four colors is completed. When the secondary transfer device 7 is adjacent to the intermediate transfer belt 6, the secondary transfer device 7 is retracted so as no to touch the intermediate transfer belt 6 until the paper is carried.

Figure 2:
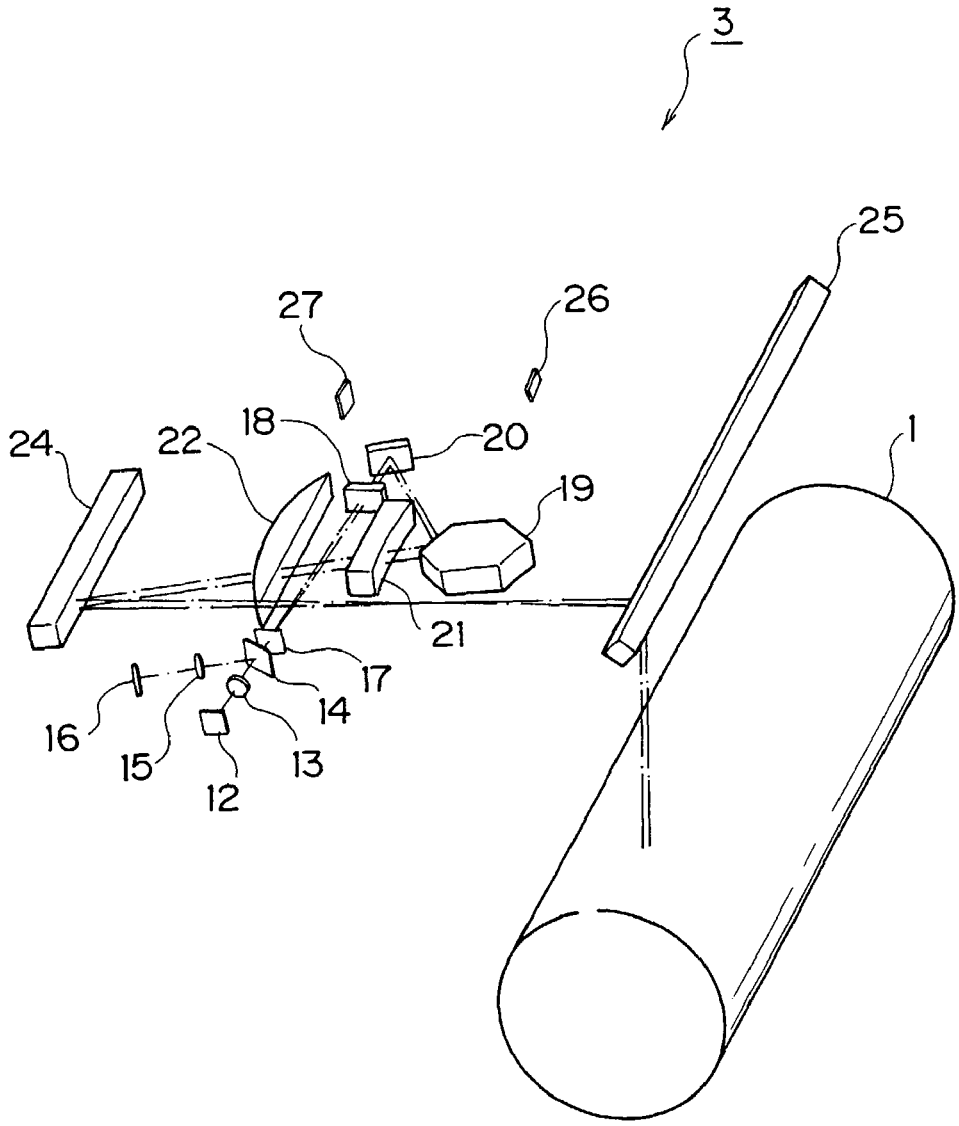
FIG. 2 is an exploded perspective view showing a configuration of an exposure apparatus.

FIG. 2 is an exploded perspective view showing the configuration of the exposure device 3. The exposure device 3 includes the vertical-cavity surface-emitting laser array 12 emitting the plurality of beams and a rotating polygon mirror 19 causing the plurality of beams to scan in the main scanning direction.

The vertical-cavity surface-emitting laser array 12 generates the plurality of beams. In FIG. 2, only two beams are shown for simplification. The vertical-cavity surface-emitting laser array 12 which is easy to form the array can generate several tens of beams. The array of the beams is not limited to one column, and can be also two-dimensionally arranged. In the embodiment, it is assumed that the vertical-cavity surface-emitting laser array 12 is two-dimensionally arranged and the number of the laser elements is 2m.

Figure 3:
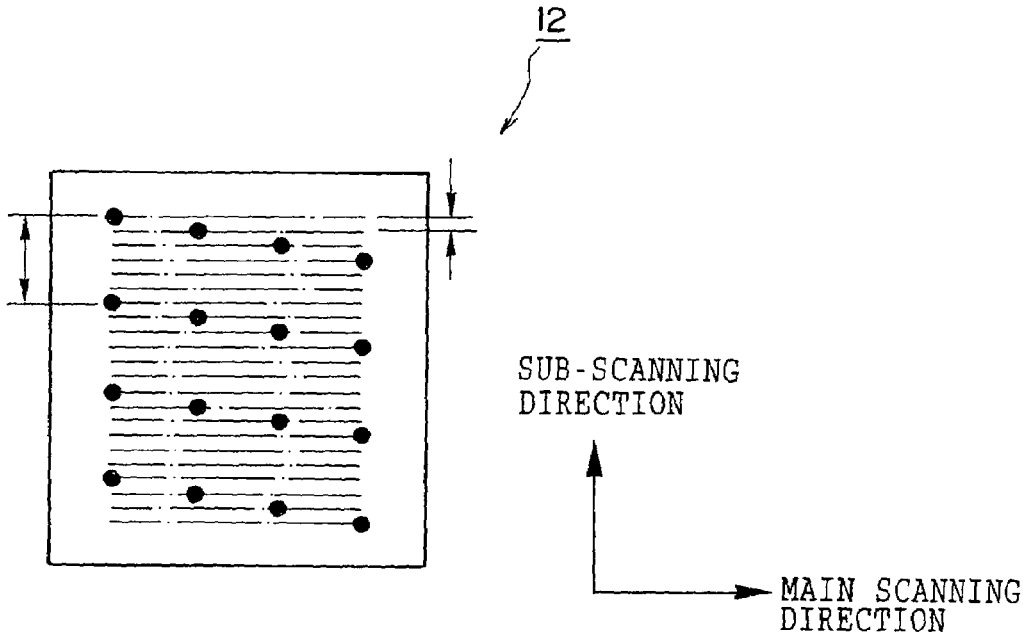
FIG. 3 is a plan view showing an example of a vertical-cavity surface-emitting laser array in which light emitting elements are two-dimensionally arranged.

FIG. 3 is a plan view showing an example of the vertical-cavity surface-emitting laser array 12 in which the light emitting elements are two-dimensionally arranged.

A collimator lens 13 causes the beam emitted from the vertical-cavity surface-emitting laser array 12 to be substantially parallel. A half mirror 14 separates part of the beam and guides it to a sensor for detecting light intensity 16 through a lens 15. Unlike an edge-emitting laser, the beam can not be emitted from a backside of a resonator in the vertical-cavity surface-emitting laser array 12. Therefore, in order to obtain a monitoring signal for controlling the light intensity, as described above, the part of the beam emitted from the vertical-cavity surface-emitting laser array 12 is guided to the sensor for detecting light intensity 16 after the separation.

An aperture 17 shapes the beam which has passed through the half mirror 14. In order to evenly shape the plurality of beams, it is desirable that the aperture 17 is arranged near a focal position of the collimator lens 13.

The beam shaped by the aperture 17 forms the long line-shaped image near a reflection plane of the rotating polygon mirror 19 in the main scanning direction with a cylindrical lens 18 having power only in the sub-scanning direction. Then, the beam is reflected in the direction of the rotating polygon mirror 19 by a reflecting mirror 20.

The rotating polygon mirror 19 is rotated by a motor, which is not shown, and deflection-reflects the beam in the main scanning direction. The beam deflection-reflected by the rotating polygon mirror 19 forms the image on the photosensitive body 1 in the main scanning direction with F-θ lenses 21 and 22 having the power only in the main scanning direction, and the beam forms the image moving at a substantially constant velocity on the photosensitive body 1. The beam which has passed through the F-θ lenses 21 and 22 forms the image on the photosensitive body 1 with cylindrical lenses 24 and 25 having the power only in the sub-scanning direction.

Because a scanning start on each refection plane of the rotating polygon mirror 19 is required to be synchronized, the exposure device 3 has a pickup mirror 26 reflecting the beam before the scanning start and a light intensity detecting sensor for synchronization 27 detecting the beam reflected by the pickup mirror 26.

A 2m channels LD driver 30 described later drives the vertical-cavity surface-emitting laser array 12 on the basis of input image data, and controls the light intensity of each laser with a laser drive control portion, which is not shown, so as to come to a given quantity.

Figure 4:
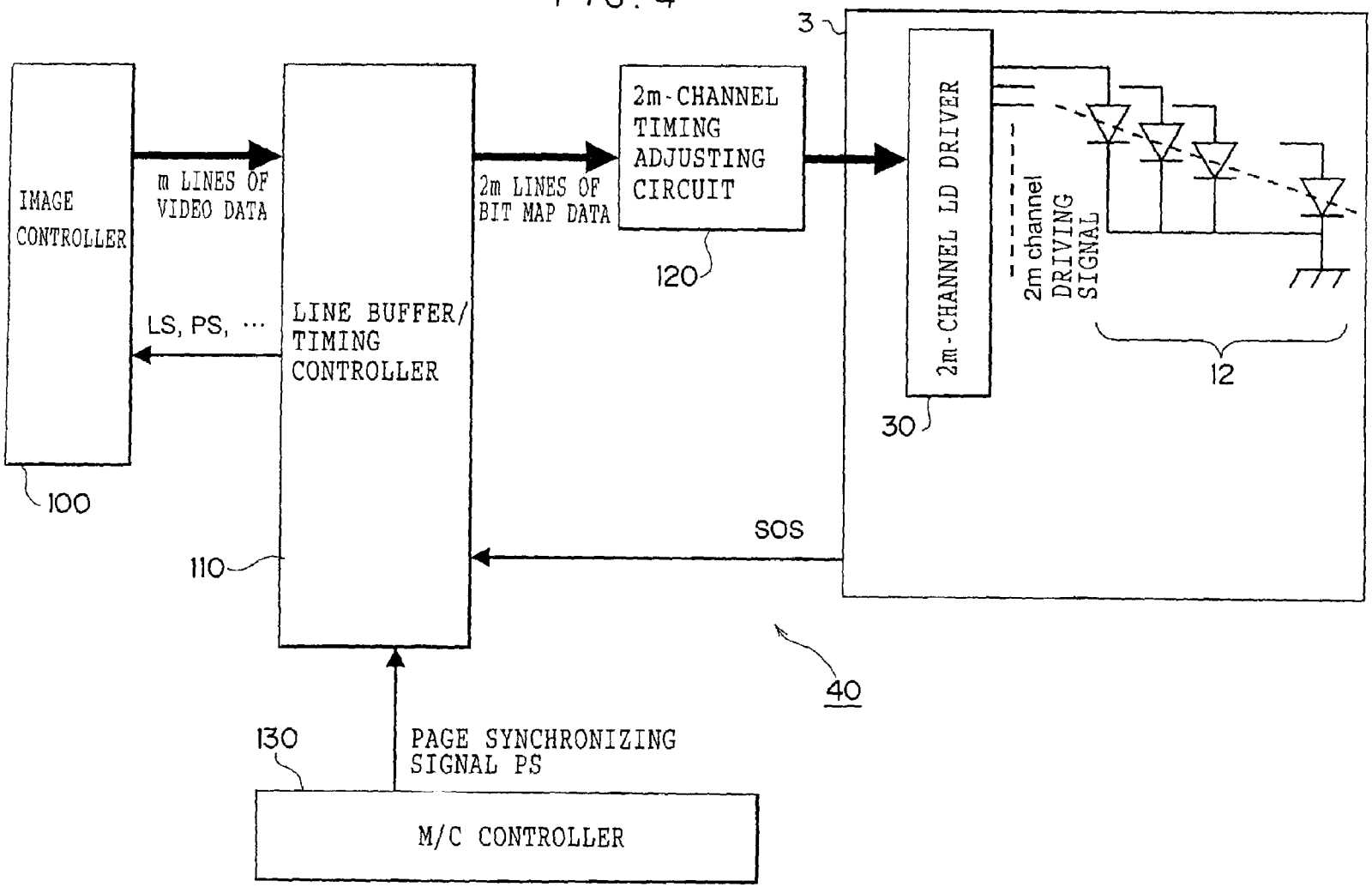
FIG. 4 is a block diagram showing a configuration of an image processing unit.

FIG. 4 is a block diagram showing the configuration on the image processing unit 40.

The image processing unit 40 includes an image controller 100 outputting the m lines of image data, a line buffer/timing controller 110 outputting the 2m lines of bit map data, a 2m channels timing adjusting circuit 120 adjusting the timing of the 2m channels of data, and an M/C controller 130 generating a page synchronizing signal PS.

The M/C controller 130 generates a page synchronizing signal indicating a start of the image formation. When the line buffer/timing controller 110 detects the page synchronizing signal, the line buffer/timing controller 110 supplies the page synchronizing signal PS corresponding to the detected page synchronizing signal and a line synchronizing signal LS corresponding to a synchronizing signal (SOS) supplied from the exposure device 3 to the image controller 100. The image controller 100 responds to the page synchronizing signal PS and the line synchronizing signal LS to output the m lines of image data.

The line buffer/timing controller 110 has the m lines of line buffers, and outputs 2m lines of data shifting m lines.

For example, in the Nth time scanning, the m lines of data of the first half in the line buffer is updated by the data in the (N−1)-th time scanning, and them lines of data of the second half is updated by the data supplied from the image controller 100. In the (N+1)-th time scanning, the m lines of data of the first half in the line buffer is updated by the data in the Nth time scanning, and the m lines of data of the second half is updated by the (N+1)-th time scanning data.

Figure 5:
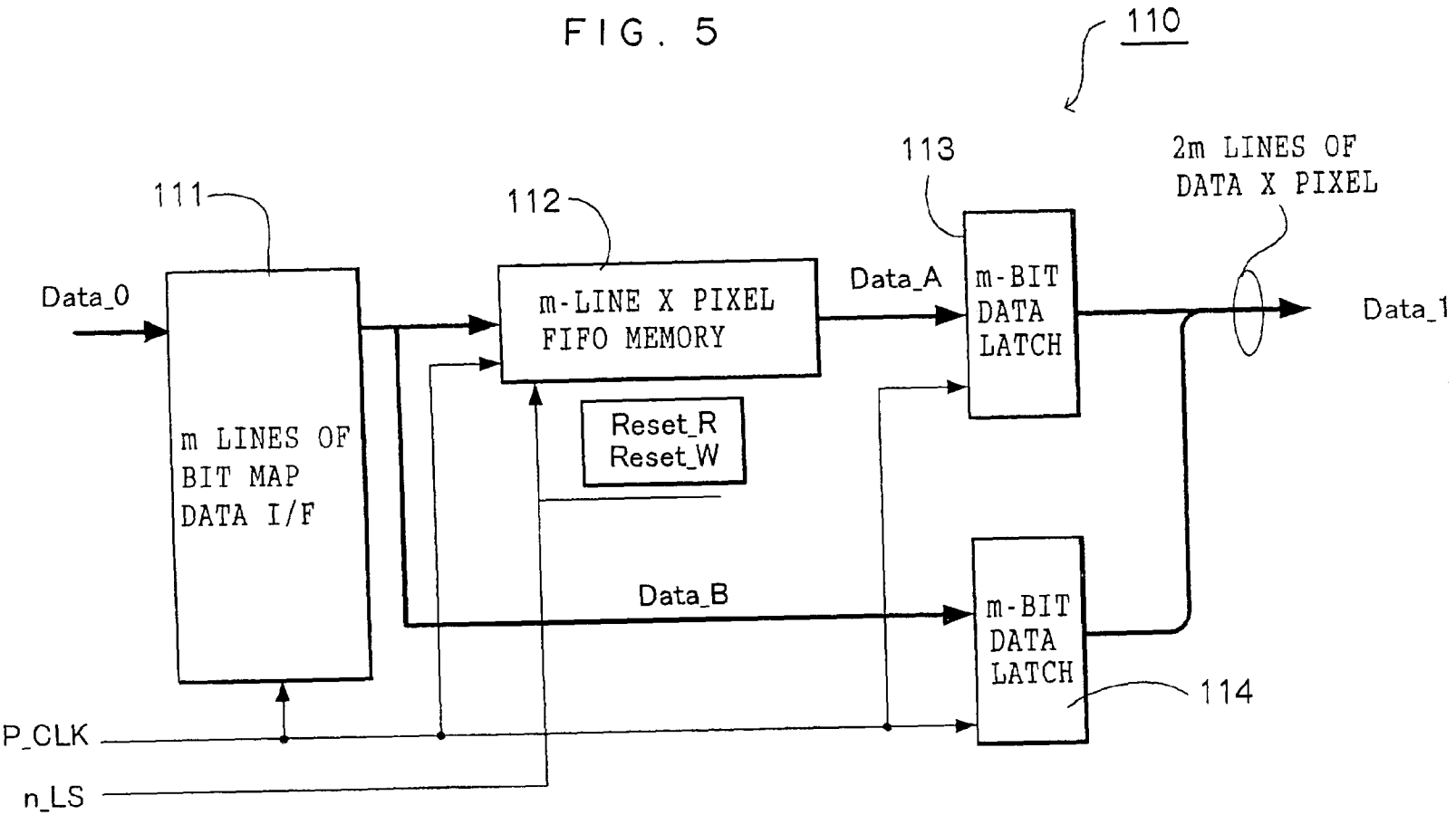
FIG. 5 is a block diagram showing a detail configuration of a line buffer/timing controller.

FIG. 5 is a block diagram showing the detail configuration of the line buffer/timing controller 110.

The line buffer/timing controller 110 includes an m lines of bit map interface 111, an m lines of X pixel FIFO memory 112, a first m-bit data latch 113, and a second m-bit data latch 114.

When the image controller 100 supplies the image data, the m lines of bit map interface 111 supplies the m lines of bit map data to the m-line X pixel FIFO memory 112 and the second m-bit data latch 114. At the same time, the m-line X pixel FIFO memory 112 outputs the data which has been written in the previous main scanning, to the first m-bit data latch 113.

Synchronizing a P clock, the first m-bit data latch 113 and the second m-bit data latch 114 latch and output each data. The data outputted from the first m-bit data latch 113 and the second m-bit data latch 114 are combined as 2m lines of data X pixel data to be supplied to the 2m-channel timing adjusting circuit 120.

Figure 6:
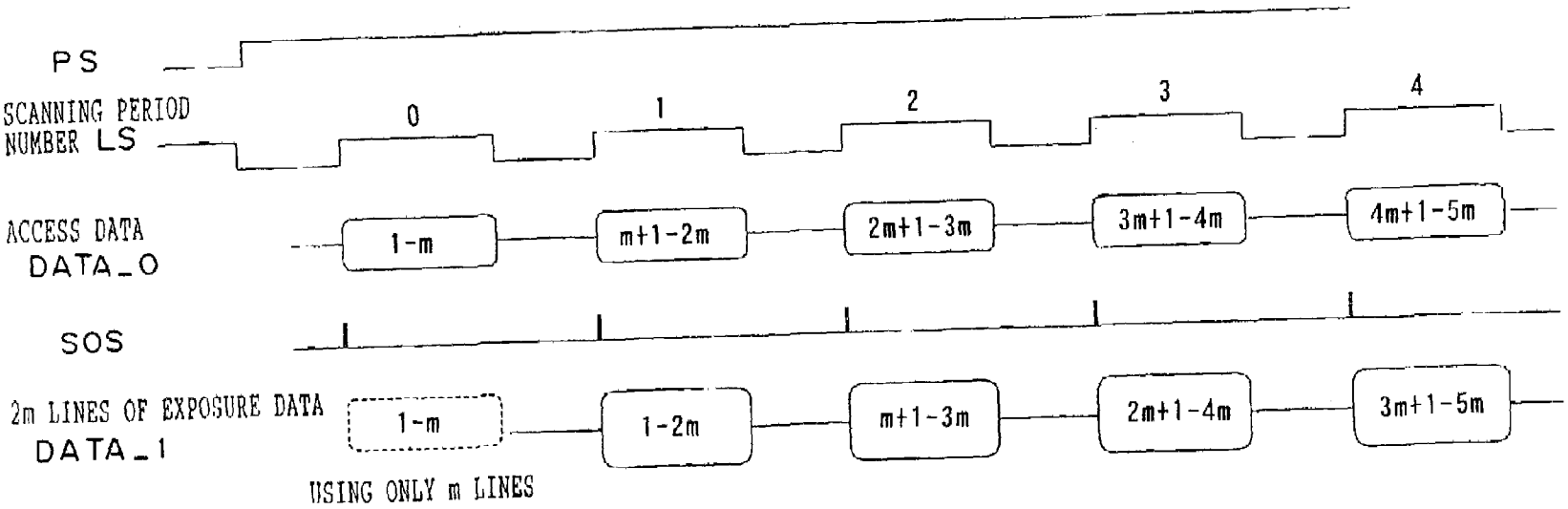
FIG. 6 is a timing chart of a page synchronizing signal PS, a scanning number, access data (Data_0), an SOS signal, and 2m lines of data (Data_1).

FIG. 6 is a timing chart of the page synchronizing signal PS, a scanning number, access data (Data_0), the SOS signal, and the 2m lines of data (Data_1).

The m-line X pixel FIFO memory 112 is reset upon receiving the page synchronizing signal PS for starting the image formation and starts data transfer when the page synchronizing signal PS is active.

The image controller 100 outputs the image data of line numbers 1 to m at timing of a line synchronizing signal LS0 and supplies the same bit map data to the m lines of bit map interface 111. While the m lines of bit map interface 111 writes the bit map data of the line numbers 1 to m in the m-line X pixel FIFO memory 112, the m lines of bit map interface 111 supplies it to the second m-bit data latch 114. At the same time, them-line X pixel FIFO memory 112 outputs the m lines of data to the first m-bit data latch 113.

Outputs of the first m-bit data latch 113 and the second m-bit data latch 114 are combined to be outputted as the 2m lines of bit map data.

The data does not exist in the m-line X pixel FIFO memory 112 at the timing of the line synchronizing signal LS0. Accordingly, the second m-bit data latch 114 outputs only the data corresponding to the line numbers 1 to m.

At the timing of a next line synchronizing signal LS1, the image controller 100 supplies the image data of line numbers (m+1) to 2m to the m lines of bit map interface 111. While the m lines of bit map interface 111 writes the bit map data of the line numbers (m+1) to 2m in the m-line X pixel FIFO memory 112, the m lines of bit map interface 111 supplies the same bitmap data to the second m-bit data latch 114. At the same time, the m-line X pixel FIFO memory 112 outputs the m lines of data to the first m-bit data latch 113.

This allows the bit map data of the line numbers 1 to 2m to be outputted from the line buffer/timing controller 110 at the timing of the line synchronizing signal LS1.

According to the configuration described above, the line buffer/timing controller 110 controls the second half of the 2m lines of data so that the second half of the 2m lines of data always corresponds to a new scanning line. That is to say, the line buffer/timing controller 110 outputs the consecutive 2m lines of data (however, the m lines of data for the first time scanning) while the line buffer/timing controller 110 shifts the m lines of data for each line synchronizing signal LS. Concretely, by outputting the data of the line numbers 1 to 2m, the data of the line numbers (m+1) to 3m, the data of the line numbers (2m+1) to 4m, . . . for each one main scanning period, overwriting is realized by the same data.

Considering that each emitting point of the vertical-cavity surface-emitting laser array 12 is not arranged in a single line in the sub-scanning direction, the 2m-channel timing adjusting circuit 120 shown in FIG. 4 adjusts the timing of data output in the main scanning direction of each scanning line, and supplies the bit map data in which the timing has been adjusted to the 2m-channel LD driver 30 in the exposure device 3.

In the color image forming apparatus having the above-described configuration, given that a distance between the scanning lines on the photosensitive body 1 is q, the main scanning is performed with the 2m-line beams at the Nth time scanning with the vertical-cavity surface-emitting laser array 12 having the 2m laser elements which are arranged two-dimensionally. Given that the amount of movement in the sub-scanning direction is P=m·q, the main scanning of the next 2m-line beam is performed at the next (N+1)-th time scanning. At this point, in a region which is exposed twice at the Nth and (N+1)-th time scanning, the same data is supplied for the same scanning line.

Figure 7:
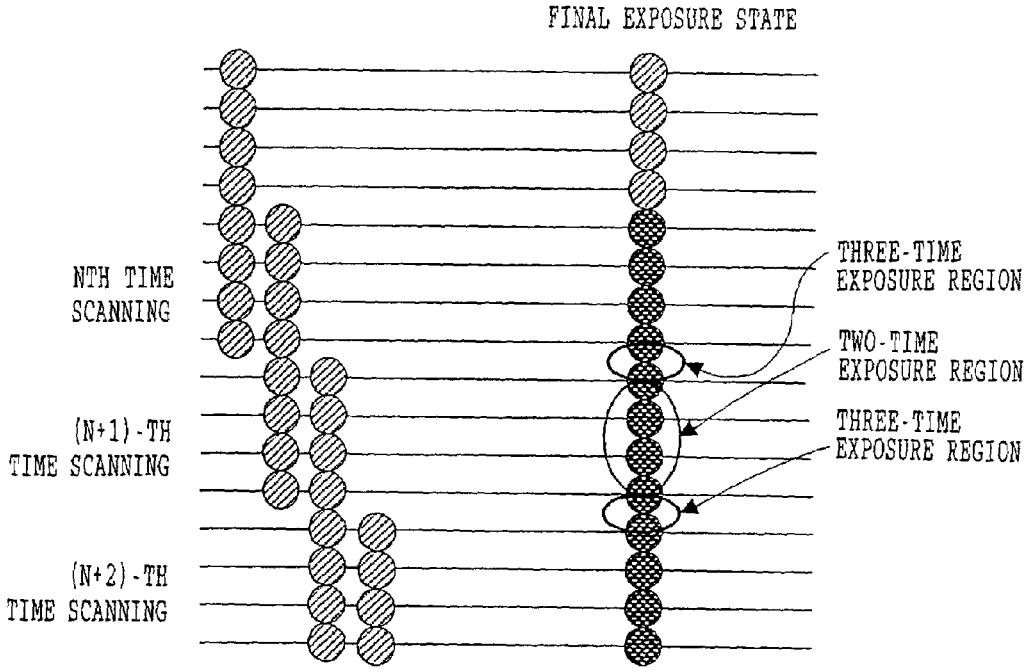
FIG. 7 shows scanning lines in the case that the number of laser elements of the vertical-cavity surface-emitting laser array is eight elements.

FIG. 7 shows the scanning lines in the case that the number of laser elements of the vertical-cavity surface-emitting 12 is eight elements.

In each of the Nth, (N+1)-th, and (N+2)-th time scanning, eight lines are formed simultaneously. At this point, four lines (the amount of the movement P=4q) are shifted in the sub-scanning direction for each termination of one main scanning, and the next scanning is performed. Accordingly, a region which is overlapped to expose between the scanning occurs in each four lines period.

Figure 8:
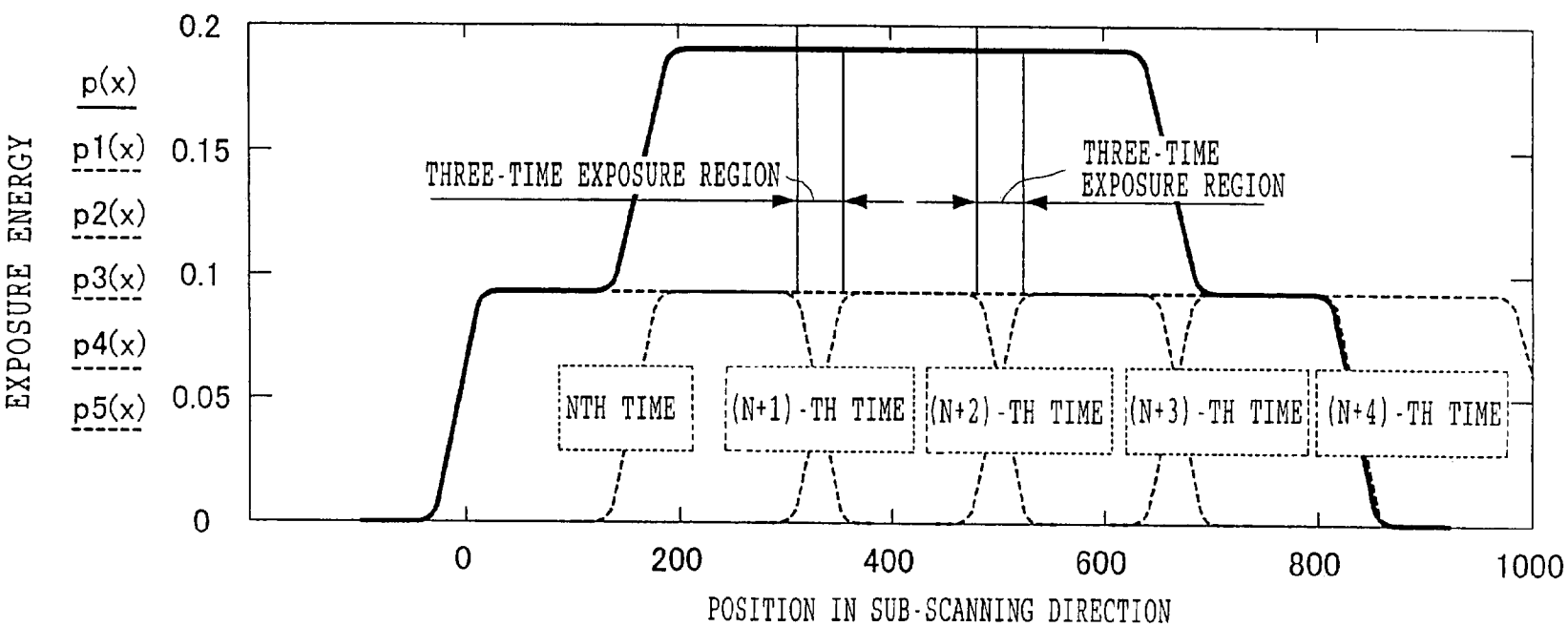
FIG. 8 shows an exposure profile indicating exposure energy for a position in a sub-scanning direction.

FIG. 8 shows an exposure profile indicating exposure energy for a position in a sub-scanning direction.

In the (N+1)-th time scanning, the exposure is performed while half of one scanning width (four lines) is shifted relative to the Nth time scanning. In the same way, in the (N+2)-th time scanning, the exposure is performed while the half of the one scanning width is shifted relative to the previous time scanning. Accordingly, as a whole, each scanning line is scanned twice (double exposure).

Further, as shown in FIG. 8, the region in which the exposures are adjacently overlapped between the scannings is generated in the scannings of Nth time and (N+2)-th time, (N+1)-th time and (N+3)-th time, (N+2)-th time and (N+4)-th time, . . . . In the region in which the exposures are adjacently overlapped between the scannings, the exposure is further performed in the scanning of (N+1)-th time, (N+2)-th time, (N+3)-th time, . . . . As a result, the triple scanning is performed in the region in which the scanning lines are adjacently overlapped, though the two-time scanning (double exposure) per one line is performed as a whole.

Since each scanning line is formed by the two-time exposure, the light intensity of the beam per scanning takes only a half. The amount of electric charge which is generated in the overlapped exposure region of the (N+1)-th and (N+2)-th time scannings is also decreased to a relatively half degree. Consequently, a change in density on the image can be decreased. Further, since the amount of movement between each of the scannings in the sub-scanning direction also becomes half, also the period of overlapped exposure region which is generated between the scannings becomes half.

Figure 15:
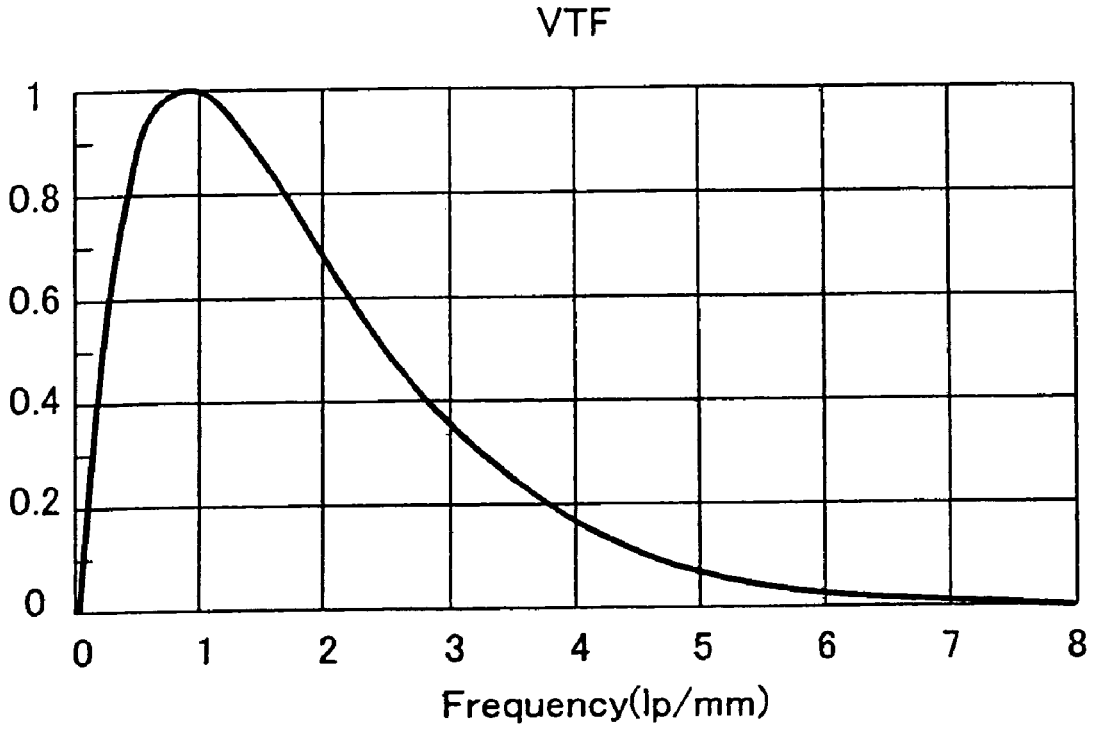
FIG. 15 Related Art
FIG. 15 shows VTF of a human eye.

For example, in the case that scanning density is 2400 dpi and the number of laser elements is 36 elements, the change in the concentration occurs in an 18 scanning-line unit. The spatial frequency of the change in the concentration becomes about 5.2 lp/mm, which is the double of 2.6 lp/mm. Considering VTF shown in FIG. 15, the visibility decreased to about 15% of 2.6 lp/mm. That is to say, the image streak is invisible and the high quality image is obtained.

As described above, in the color image forming apparatus, the change in the concentration of the streaks which appear in the image by performing the double exposure is decreased and the spatial frequency in which the streak is generated is increased, so that the visibility of the streaks which appear in the image can be decreased and the high quality image can be formed. Consequently, miniaturization of the apparatus can be also achieved without using the adjustable mechanism or the circuit which is described in, e.g., JP-A Nos. 4-149523 or 4-149522.

Although, the case that the scanning density is 2400 dpi and the number of laser elements is 36 elements is described, the present invention is not limited to the case.

For example, for the case that scanning density is 1200 dpi and the number of laser elements is 36 elements, the spatial frequency of the change in the concentration becomes 2.6 lp/mm when the double exposure is performed. Since the double exposure decreases the change in the concentration, which is generated in a seam of the scanning, the visibility of the streak is decreased.

In the case that the change in the concentration should be further improved, the shift per one main scanning in the sub-scanning direction may be set to one-fourth of the scanning width and the same scanning line may be formed by the four-time exposure. This enables the spatial frequency of the change in the concentration to be about 5.2 lp/mm (>4 lp/mm). Also, the change in the concentration, which is generated in the seam of the scanning, can be further decreased, and visibility can be also decreased.

Thus, the shift per one main scanning in the sub-scanning direction (the number of lines to be shifted) is not particularly restricted. However, when the number of light emitting elements of the vertical-cavity surface-emitting laser array 12 is 2m, it is required that the number of lines to be shifted is a divisor of 2m in order to make the number of exposures of each scanning line uniform. A smaller value from among divisors of 2m may be used as the number of lines to be shifted when image quality is a high priority, and a larger value from among divisors of 2m may be used as the number of lines to be shifted when image forming speed is a high priority.

(Second Embodiment)

A second embodiment of the invention will be described. The same reference numerals are used for the same part as that of the first embodiment, and the overlapped description is omitted.

Though the color image forming apparatus according to the embodiment is formed in almost the same way as the first embodiment, an interlaced scanning is utilized as the laser scanning method.

Figures 9, 10:
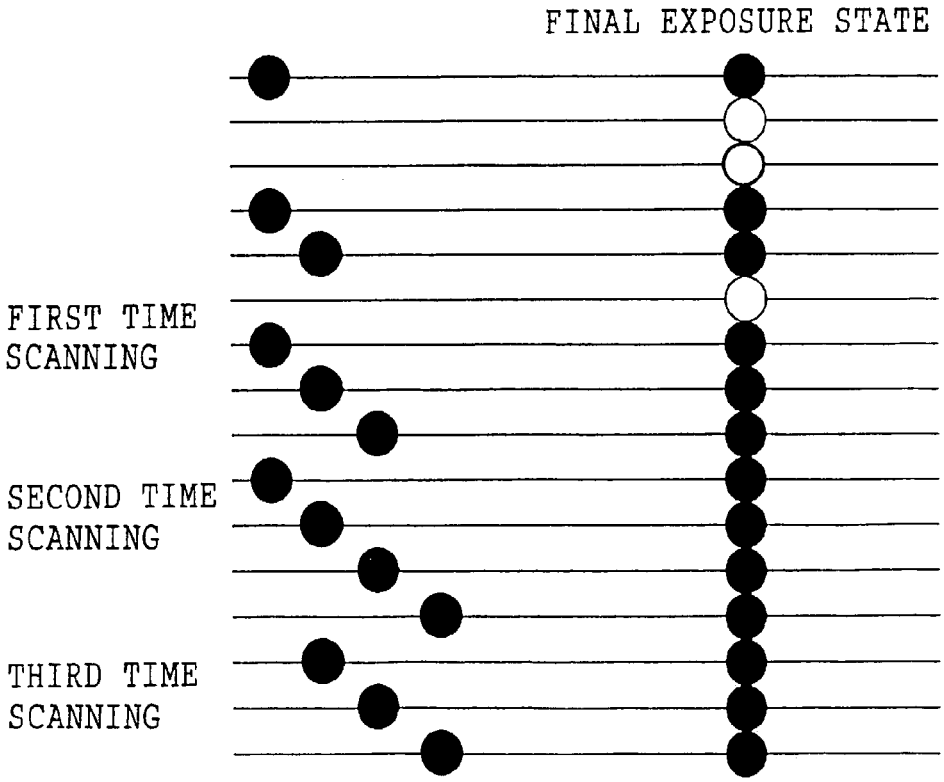
FIG. 9 shows a combination of m and n, in which an interlaced scanning can be performed, wherein m represents the number of beams and n represents an interlaced period.
FIG. 10 shows scanning lines of the interlaced scanning performed by the vertical-cavity surface-emitting laser array having four laser elements.

FIG. 9 shows a combination of m and n, in which the interlaced scanning can be performed, when the number of beams is set to m and an interlaced period is set to n. According to FIG. 9, in order to perform the interlaced scanning, it is required that m and n are prime natural numbers each other (see JP-A No. 5-53068).

FIG. 10 shows the scanning lines when the interlaced scanning has been performed in the case that the number of laser elements of the vertical-cavity surface-emitting laser array is 4.

According to FIGS. 9 and 10, the interlaced period n must be not lower than 3 (3, 5, 7, 9, . . . ) in the case that the number of laser elements of the vertical-cavity surface-emitting laser array is 4. In this case, since it is necessary that optical magnification in the sub-scanning direction is not lower than three times compared with the optical magnification in the sub-scanning direction in the case of the adjacent scanning, there is a problem that aberration and the like are increased and large restriction is generated in optical design.

Therefore, the color image forming apparatus according to the embodiment is formed as follows so that not only the color image forming apparatus is not constrained by conditions for the interlaced scanning but also degree of freedom in the optical design is not lost.

Figure 11:
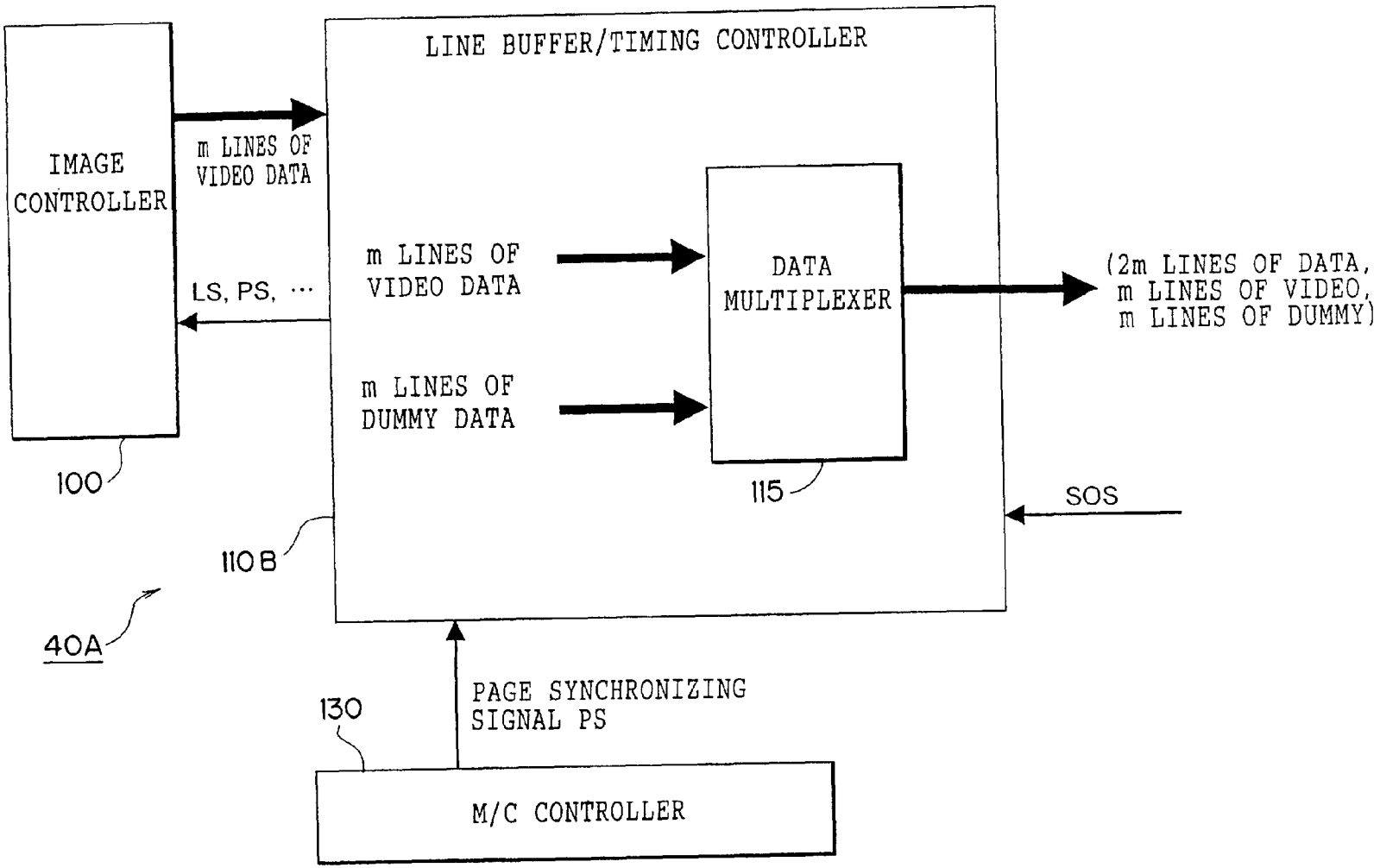
FIG. 11 is a block diagram showing a configuration of an image processing unit 40A according to a second embodiment.

The color image forming apparatus according to the embodiment utilizes the image processing unit 40A having the configuration shown in FIG. 11 instead of the image processing unit 40 having the configuration shown in FIG. 4.

FIG. 11 is the block diagram showing the configuration of the image processing unit 40A according to the second embodiment.

The image processing unit 40A includes the image controller 100, a line buffer/timing controller 110B, and the M/C controller 130.

The image controller 100 supplies the m lines of image data corresponding to the scanning line, which should be formed, to the line buffer/timing controller 110B.

The line buffer/timing controller 110B includes a data multiplexer 115. The data multiplexer 115 synthesizes the m lines of image data and m lines of dummy data (the data is 0) corresponding to the laser element which is not turned on. At this point, the data multiplexer 115 controls arrangement of the m lines of image data and the m lines of dummy data, sorts properly each data, and outputs the 2m lines of data in each one main scanning.

The line buffer/timing controller 110B supplies the 2m lines of data including the m lines of image data and the m lines of dummy data corresponding to the laser element which is not turned on to the 2m-channel LD driver 30 in the exposure device 3 in each one main scanning period.

Consequently, the 2m-channel LD driver 30 turns on the m light emitting elements of the vertical-cavity surface-emitting laser array 12 and turns off other m light emitting elements, and changes the light emitting element which is turned on/off in each one main scanning period.

Figure 12:
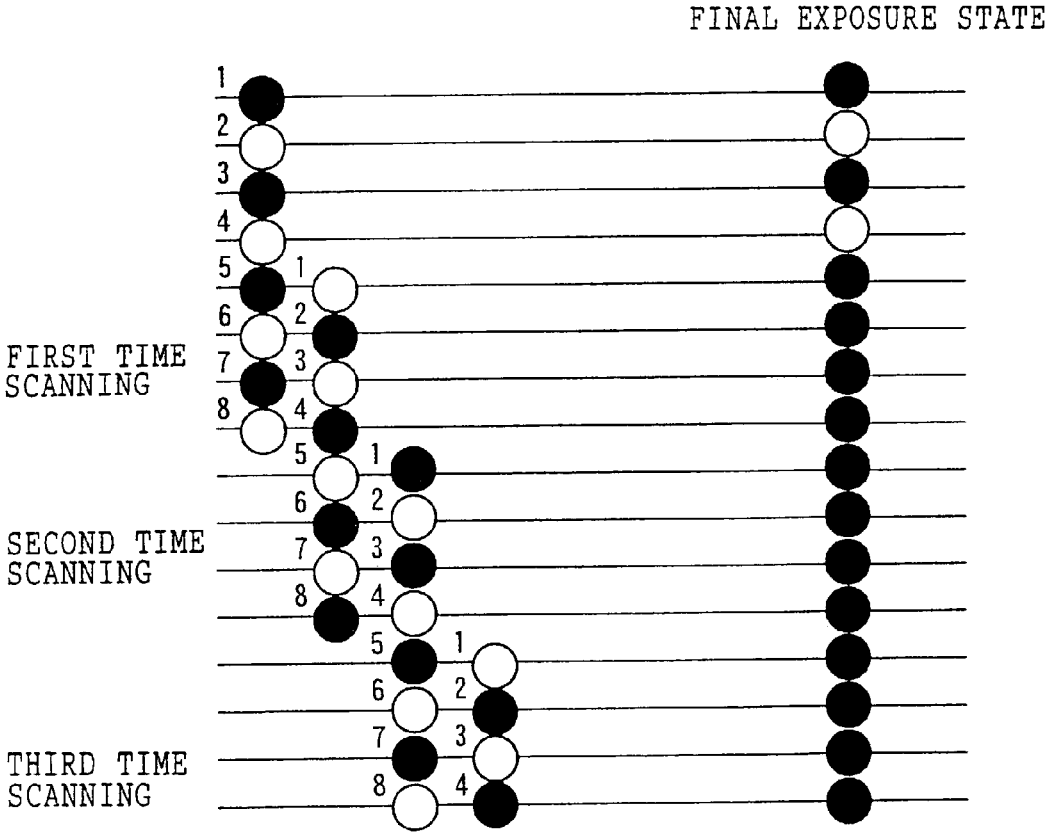
FIG. 12 shows scanning lines in the case that the number of laser elements of the vertical-cavity surface-emitting laser array is eight elements.
Figure 13:
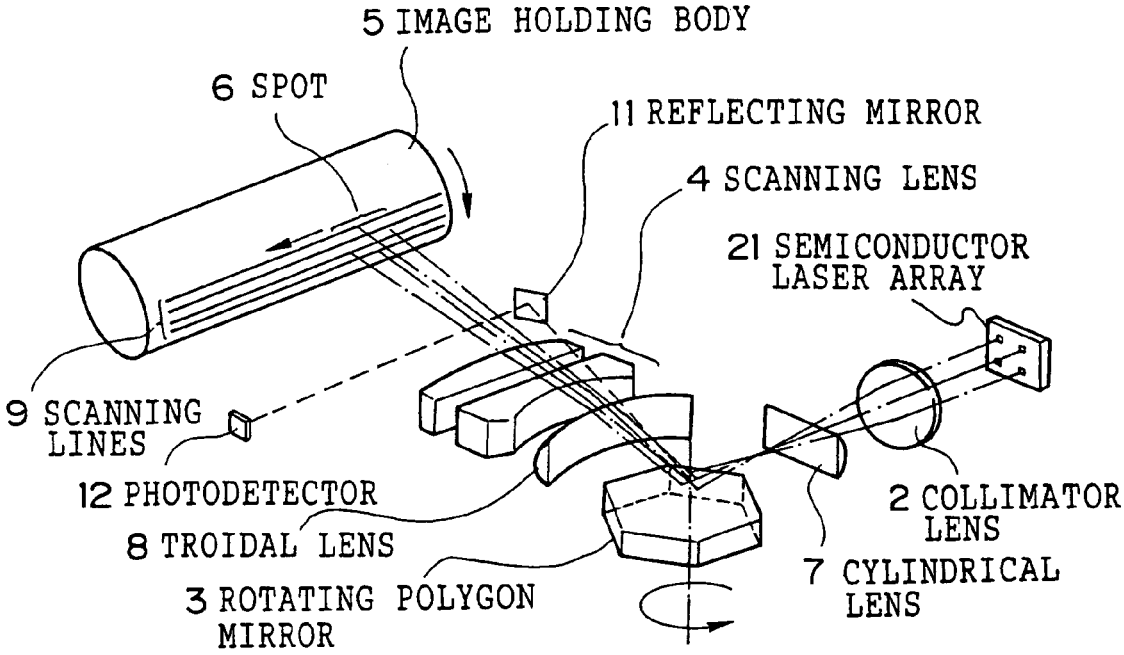
FIG. 13 Related Art
FIG. 13 is an exploded perspective view showing the configuration of an image forming apparatus of the related art.
Figure 14:
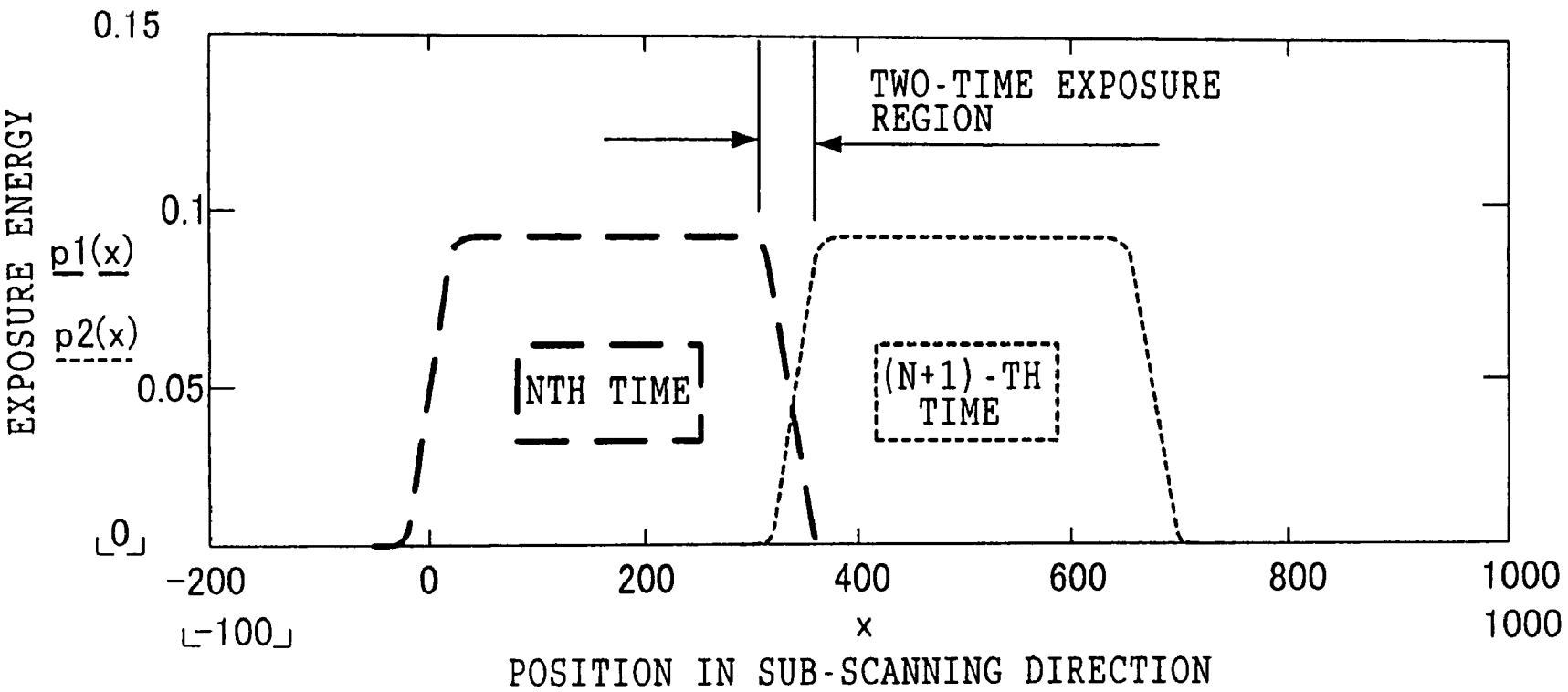
FIG. 14 Related Art
FIG. 14 shows the exposure profile of an adjacent scanning method indicating the exposure energy for the position of the sub-scanning direction.

FIG. 12 shows the scanning lines in the case that the number of laser elements of the vertical-cavity surface-emitting laser array is eight elements.

In the first time scanning, the scanning is performed with the beams whose element numbers are 1, 3, 5, and 7, and then, in the second time scanning, the scanning is performed from the position where the beams are shifted by four lines in the sub-scanning direction with the beams whose element numbers are 2, 4, 6, and 8.

Then, the scanning is performed with the beams whose element numbers are an odd number in the odd-numbered scanning, and the scanning is performed with the beams whose element numbers are an even number in the even-numbered scanning. Thus, the exposure of the two-line interlaced scanning is realized. In this case, when the image data starts from the element number of 5 in the first time scanning, the image can be formed without an interstice.

In the exposure of the two-line interlaced scanning, each scanning line is affected by not only the exposure of the adjacent scanning line but also the multiple-time exposure.

For example, in the case of the same conditions as the first embodiments, i.e., the resolution is 2400 dpi and the number of laser elements is 36, the adjacent scanning line affects each scanning line. Accordingly, the spatial frequency in which the streak is generated is about 94.51 lp/mm corresponding 2400 dpi, so that the visibility of the streak Some scanning lines are affected by the double exposure and others are affected by the triple exposure. However, their period of repeating is the same as the double exposure having the 18-scanning-line period and the spatial frequency is about 5.2 lp/mm, so that the visibility is low.

In the color image forming apparatus, given that the distance between the scanning lines on the photosensitive body 1 is q, when the numbers from 1 to 2m are assigned to each element from the upstream of scanning line to the downstream of scanning line, the scanning lines are formed by performing the main scanning of the m-line beams with the beams from the odd-numbered elements at the Nth (odd-numbered) time scanning. Given that the amount of movement in the sub-scanning direction is $P=m \cdot q$, the exposure of the two-line interlaced scanning is performed by the main scanning of the m-line beams with the beams from the even-numbered elements at the (N+1)-th (even-numbered) time scanning.

As described above, the color image forming apparatus according to the embodiment has the 2m laser elements, and the interlaced scanning is performed in such a manner that Nth time scanning and the (N+1)-th time scanning are performed by using the different elements, so that the exposure conditions of each scanning line can be substantially uniformed and the generation of the image streak can be suppressed. Furthermore, the color image forming apparatus is not constrained by conditions for the interlaced scanning and the degree of freedom in the optical design is not lost.

In the color image forming apparatus, it is necessary that the light intensity is set to about double of the double exposure, because each scanning line is formed by the one time exposure unlike the double exposure. Changing the elements which are turned on in each main scanning, lighting time of each light emitting element can be decreased to about a half of the double exposure to suppress burden of the light emitting element.

In the same way as the case of the double exposure, since it is not necessary to adjust each light emitting element, the adjustable mechanism and the circuit, which are used for adjusting the streak appeared on the image, are not required.

(Third Embodiment)

A third embodiment of the invention will be described.

The color image forming apparatus can output the color image and the monochrome (B/W) image, and have a plurality of image quality modes. As concerns the image quality mode, for example, there is the color mode in which the high quality image is required rather than the speed, the monochrome mode in which productivity (high speed) is required rather than the image quality, or the like.

Although, the image forming apparatus adopting the double scanning method shown in the first embodiment and the image forming apparatus adopting the interlaced scanning method shown in the second embodiment can form the high quality image, since the shift in the sub-scanning direction is half of the adjacent scanning, the double scanning method and the interlaced scanning method do not reach the adjacent scanning method for the productivity.

Figure 16:
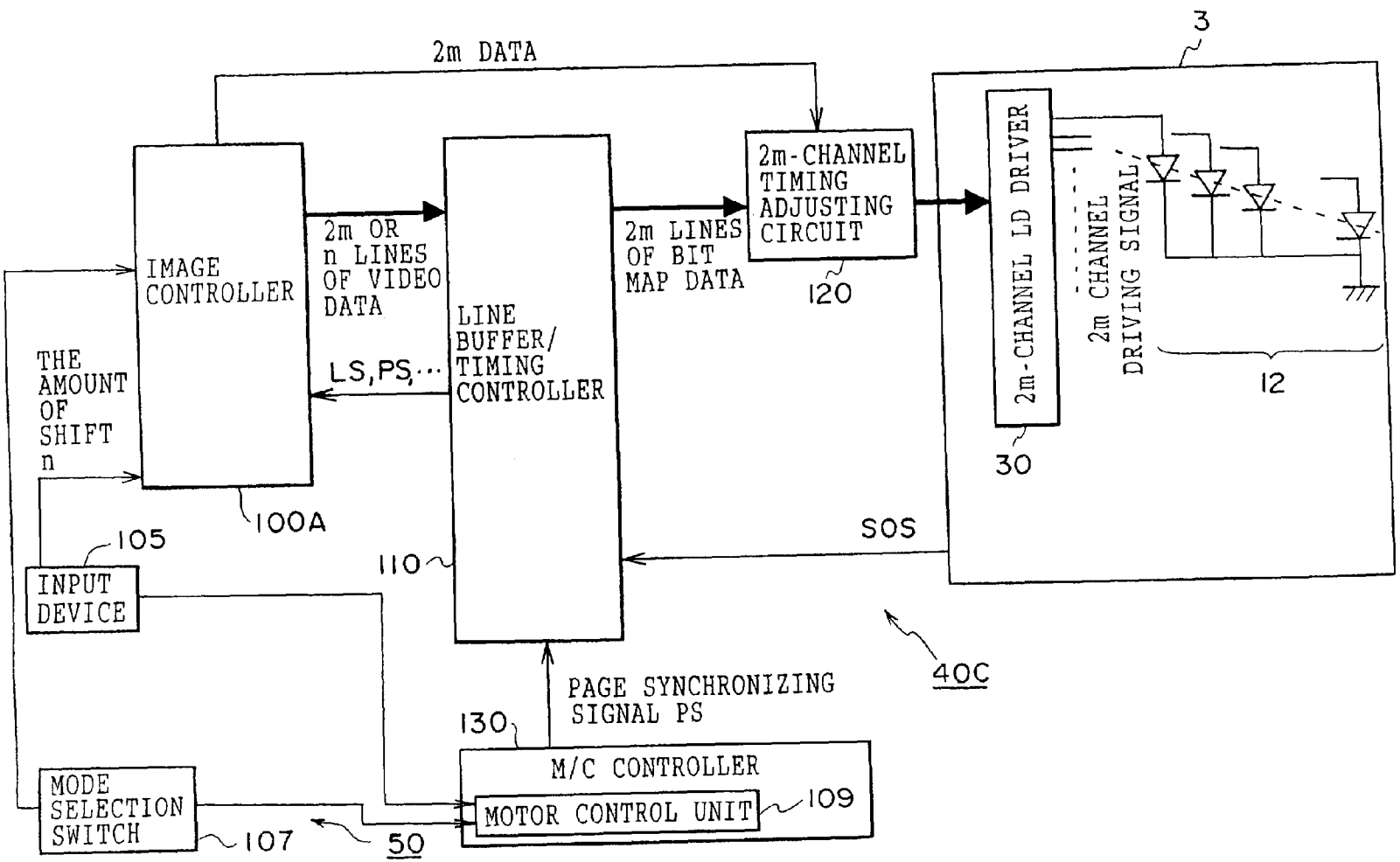
FIG. 16 is a block diagram showing the configuration of the image processing unit and a motor control unit according to a third embodiment.

Accordingly, the image forming apparatus according to the third embodiment performs image control and motor control so as to be able to cope with the adjacent scanning method and the double scanning method. FIG. 16 shows an image processing unit 40C and a motor controlling unit 50 according to the embodiment. In this example, either the adjacent scanning method or the double scanning method is selected according to the image quality mode and/or the color mode/monochrome mode, which is selected by a mode selection switch 107.

A motor control unit 109 controls a drive motor (not shown) for rotating the photosensitive body 1 so that the amount of shift in the sub-scanning direction is suitable for the scanning method corresponding to the image quality mode or the like, which is selected by the mode selection switch 107. Also, when the double scanning method is selected, the motor control unit 109 controls the drive motor for rotating the photosensitive body 1 according to the amount of shift n which is inputted with an input device 105.

When the adjacent scanning method is selected, an image controller 100A outputs the 2m lines of image data to the line buffer/timing controller 110. On the other hand, when the double scanning method is selected, the image controller 100A outputs the n lines of data to the line buffer/timing controller 110 according to the amount of shift which is inputted with the input device 105.

When the adjacent scanning method is selected, the line buffer/timing controller 110 outputs the 2m lines of image data to the 2m-channel timing adjusting circuit 120. On the other hand, when the double scanning method is selected, the line buffer/timing controller 110 operates as explained in the first embodiment.

By adopting the above-described configuration, in the image forming apparatus according to the embodiment, when the color mode is selected, the high quality image can be formed by selecting the double scanning. When the monochrome mode is selected, the productivity can be improved by selecting the adjacent scanning to double the image forming speed. Particularly, in the monochrome mode, the image forming speed can be doubled without increasing a clock frequency of the image data, so that the image forming apparatus can cope with the image forming speed of the adjacent scanning.

Though the image streak is generated in the monochrome mode, there is no problem because the requirement of the image quality is low. As described in JP-A No. 4-149522, the control which causes the streak to be inconspicuous may be performed by correcting the light intensity of the element which is placed on an end portion of each laser beam group.

The double scanning method and the adjacent scanning method can be switched according to the selected image quality mode. At this point, the double scanning may be selected in the mode in which the high quality image is required, and the adjacent scanning may be selected to form the image at high speed in the mode in which the image quality is not required (high speed mode).

Figure 17:
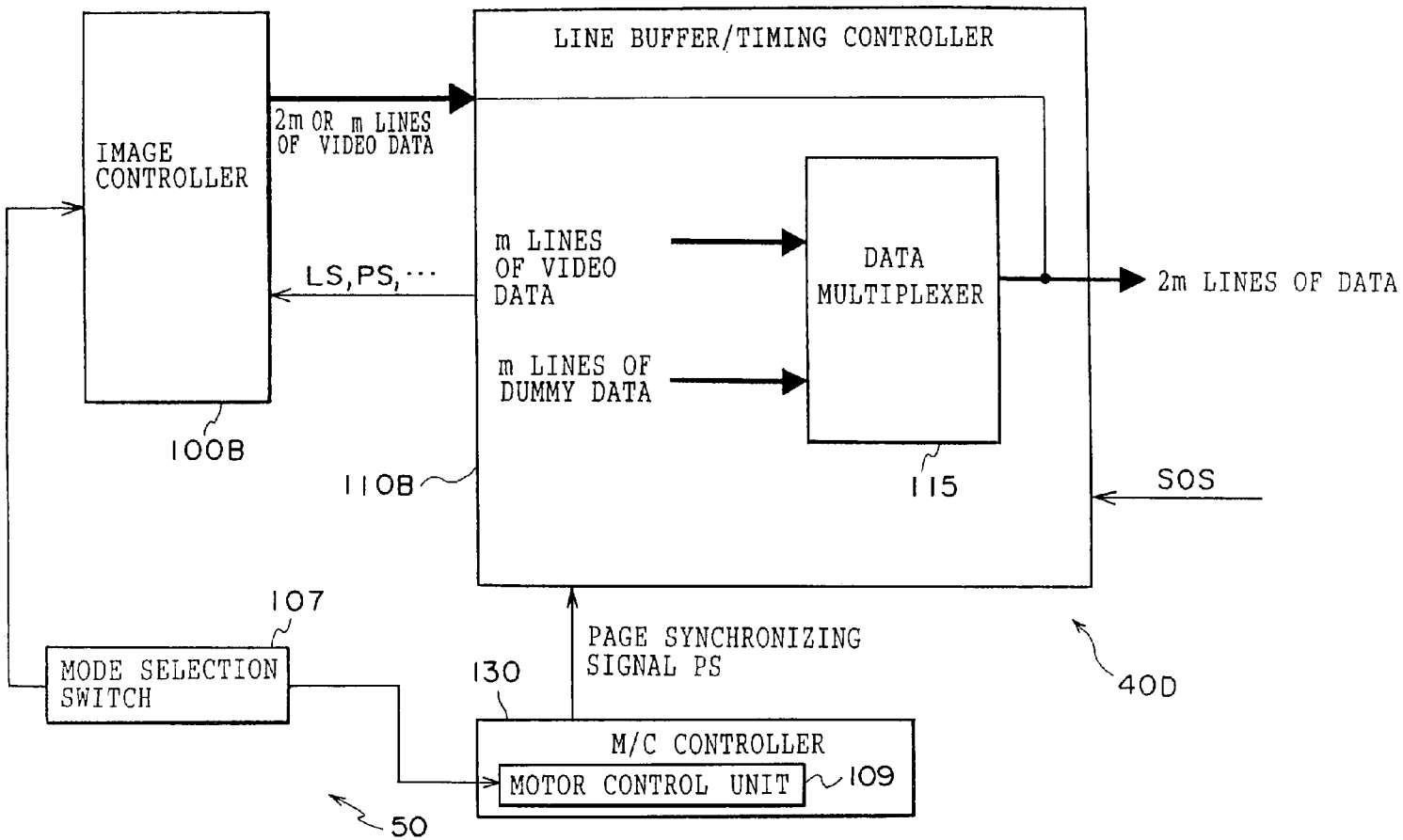
FIG. 17 is a block diagram showing the configuration of the image processing unit and a motor control unit according to a third embodiment.

Further, the image forming apparatus may have the adjacent scanning method and the interlaced scanning method shown in the second embodiment and change an exposure form with the color mode/monochrome mode or the image quality mode. FIG. 17 shows an image processing unit 40D and the motor controlling unit 50 in such example. Either the adjacent scanning or the interlaced scanning is performed according to the image quality mode, the color mode/monochrome mode, or the like, which is selected by the mode selection switch 107.

The motor control unit 109 controls the drive motor for rotating the photosensitive body 1 so that the amount of shift in the sub-scanning direction is suitable for the scanning method corresponding to the image quality mode and/or the color mode/monochrome mode, which is selected by the mode selection switch 107.

When the adjacent scanning method is selected, the image controller 100B outputs the 2m lines of image data to the line buffer/timing controller 110B. On the other hand, when the interlaced scanning method is selected, the image controller 100B outputs the m lines of data to the line buffer/timing controller 110B.

When the adjacent scanning method is selected, the line buffer/timing controller 110B outputs the 2m lines of image data to the 2m channels timing adjusting circuit 120. On the other hand, when the interlaced scanning method is selected, the line buffer/timing controller 110B operates as explained in the second embodiment.

Further, the image forming apparatus may have the double scanning method shown in the first embodiment and the interlaced scanning method shown in the second embodiment as the exposure form. In this case, though the image forming speed is the same in both methods, because the exposure forms are different, the image quality is slightly different and characteristics such as gradation are also different between both of them. Therefore, the desired image quality or the gradation may be determined by selecting the desired image quality mode.

Figure 18:
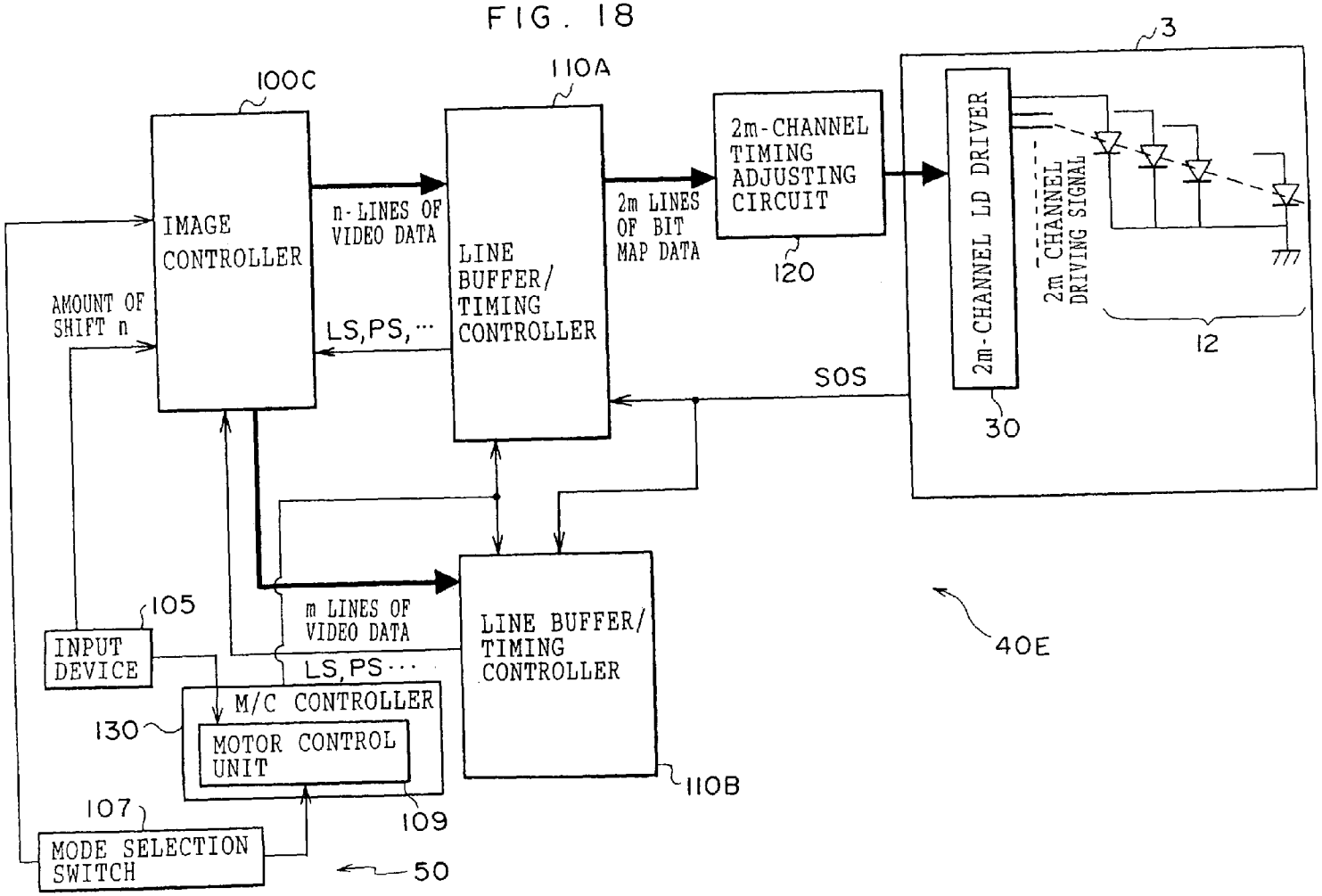
FIG. 18 is a block diagram showing the configuration of the image processing unit and a motor control unit according to a third embodiment.

FIG. 18 shows an image processing unit 40E and the motor controlling unit 50 according to the embodiment. In this example, either the adjacent scanning or the interlaced scanning is selected according to the image quality mode or the like, which is selected by the mode selection switch 107.

The motor control unit 109 controls the drive motor for rotating the photosensitive body 1 so that the amount of shift in the sub-scanning direction is suitable for the scanning method corresponding to the image quality mode or the like, which is selected by the mode selection switch 107. Also, when the double scanning method is selected, the motor control unit 109 controls the drive motor for rotating the photosensitive body 1 according to the amount of shift n which is inputted with the input device 105. When the double scanning method is selected, an image controller 100C outputs the n lines of image data, according to the amount of shift n inputted with the input device 105, to the line buffer/timing controller 110A. On the other hand, when the interlaced scanning method is selected, the image controller 100C outputs the n lines of data, according to the amount of shift n inputted with the input device 105, to the line buffer/timing controller 110B.

In the third embodiment, though the example is shown to select the scanning method in such a manner that the mode selection switch 107 manually selects the mode such as the image quality mode, the color mode/monochrome mode, or the like, the invention is not limited to the example, and the scanning method may be automatically selected according to the image quality, color setting, or the like, which is set at the stage in which the image is inputted to the image processing unit 40. Though the example is shown to input the amount of shift n with the input device 105, the invention is not limited to the example, and the amount of shift n may be automatically adjusted according to the image quality, color setting, or the like.

As described above, according to the invention, the multiple scanning per one scanning line can decrease the light intensity of each beam and the change in the concentration, which is generated in each scanning line.

Further, according to the invention, when the photosensitive body is scanned with the plurality of beams, visibility of the image streak can be decreased, and a high quality image can be obtained by increasing the spatial frequency of the image streak which is generated due to reciprocity law failure of the laser scanning and the photosensitive body.

What is claimed is:

1. An image forming apparatus comprising:

a laser array having m light emitting elements in a sub-scanning direction;

a data shifter that outputs m lines of image data in the sub-scanning direction for one main scanning period, subsequently reads image data which is a subject of a next output with the image data shifted by n lines in the sub-scanning direction, n being a divisor of m, and repeats said outputting and reading;

a driver that drives each light emitting element of said laser array so as to emit a beam, on the basis of the image data which has been outputted from said data shifter; and a scanning unit that causes the beams which are emitted from said laser array to scan in a main scanning direction for said one main scanning period, subsequently moves a scanning start position for a next one main scanning period by said n lines in the sub-scanning direction, and repeats said scanning and moving, wherein the driver scales the intensity of light emitted by each light emitting element substantially by a ratio of n/m.

2. An image forming apparatus according to claim 1, further comprising an operational mode setting unit that sets a value of said n lines for said data shifter and said scanning unit according to an operational mode.

3. An image forming apparatus according to claim 2, wherein said operational mode is an image quality mode.

4. An image forming apparatus comprising:

a laser array having m light emitting elements in a sub-scanning direction;

a data shifter that outputs m lines of image data in the sub-scanning direction for one main scanning period, subsequently reads image data which is a subject of a next output with the image data shifted by n lines in the sub-scanning direction, n being a divisor of m, and repeats said outputting and reading;

a driver that drives each light emitting element of said laser array so as to emit a beam, on the basis of the image data which has been outputted from said data shifter;

a scanning unit that causes the beams which are emitted from said laser array to scan in a main scanning direction for said one main scanning period, subsequently moves a scanning start position for a next one main scanning period by said n lines in the sub-scanning direction, and repeats said scanning and moving; and an operational mode setting unit that sets a value of said n lines for said data shifter and said scanning unit according to an operational mode;

wherein said operational mode is a monochrome mode or a color mode.

5. An image forming apparatus comprising:

a laser array having m light emitting elements in a sub-scanning direction;

a data shifter that outputs m lines of image data in the sub-scanning direction for one main scanning period, subsequently reading image data which is a subject of a next output with the image data shifted by n lines in the sub-scanning direction, n being a divisor of m, and repeats said outputting and reading;

a driver that drives each light emitting element of said laser array so as to emit a beam, on the basis of the image data which has been outputted from said data shifter;

a scanning unit that causes the beams which are emitted from said laser array to scan in a main scanning direction for said one main scanning period, subsequently moves a scanning start position for a next one main scanning period by said n lines in the sub-scanning direction, and repeats said scanning and moving; and an operational mode setting unit that sets a first or second operational mode, wherein:

when the first operational mode is set, said data shifter outputs m lines of image data in the sub-scanning direction for one main scanning period, subsequently reads image data which is a subject of a next output with the image data shifted by n lines in the sub-scanning direction, n being a divisor of m, and repeats said outputting and reading, and when the second operational mode is set, said data shifter outputs 2m lines of image data for each one main scanning period; and when the first operational mode is set, said scanning unit causes the beams which are emitted from said laser array to scan in a main scanning direction for said one main scanning period, subsequently moves a scanning start position for a next one main scanning period by said n lines in the sub-scanning direction, and repeats said scanning and moving, and when the second operational mode is set, said scanning unit causes the beams which are emitted from said laser array to scan in a main scanning direction for said one main scanning period, subsequently moves a scanning start position for a next one main scanning period by said 2m lines in the sub-scanning direction, and repeats said scanning and moving.

6. An image forming apparatus according to claim 5, wherein said first operational mode is a color mode, and said second operational mode is a monochrome mode.

7. An image forming apparatus according to claim 5, wherein said first operational mode has a higher image quality than that of said second operational mode.

8. An image forming apparatus comprising:

a laser array having 2m light emitting elements in a sub-scanning direction;

a data arranger that outputs 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period;

a driver that drives each light emitting element of said laser array so as to emit a beam, on the basis of the image data which has been outputted from said data arranger;

a scanning unit that causes the beams which are emitted from said laser array; to scan in a main scanning direction for said one main scanning period, subsequently moves a scanning start position for a next one main scanning period by said m lines in the sub-scanning direction, and repeats said scanning and moving.

9. An image forming apparatus according to claim 8, further comprising an operational mode setting unit that sets a first or second operational mode, wherein:

when the first operational mode is set, said data arranger outputs 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period, and when the second operational mode is set, said data arranger outputs 2m lines of image data for each one main scanning period; and when the first operational mode is set, said scanning unit causes the beams which are emitted from said laser array to scan in a main scanning direction for said one main scanning period, subsequently moves a scanning start position for a next one main scanning period by said m lines in the sub-scanning direction, and repeats said scanning and moving, and when the second operational mode is set, said scanning unit causes the beams which are emitted from said laser array to scan in a main scanning direction for said one main scanning period, subsequently moves a scanning start position for a next one main scanning period by said 2m lines in the sub-scanning direction, and repeats said scanning and moving.

10. An image forming apparatus according to claim 9, wherein said first operational mode is a color mode, and said second operational mode is a monochrome mode.

11. An image forming apparatus according to claim 9, wherein said first operational mode has a higher image quality than that of said second operational mode.

12. An image forming apparatus comprising:

an operational mode setter that sets a first or a second operational mode;

a laser array having 2m light emitting elements in a sub-scanning direction;

a data output unit that outputs 2m lines of image data in the sub-scanning direction for one main scanning period, subsequently shifts image data which is a subject of a next output by n lines in the sub-scanning direction, n being a divisor of 2m, and repeats said outputting and shifting, when the first operational mode is set, and outputs 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period, when the second operational mode is set;

a driver that drives each light emitting element of said laser array so as to emit a beam, on the basis of the image data which has been outputted from said data output unit; and a scanning unit that causes the beams which are emitted from said laser array to scan in a main scanning direction for said one main scanning period, subsequently moves a scanning start position for a next one main scanning period by said n lines in the sub-scanning direction, and repeats said scanning and moving, when the first operational mode is set, and that causes the beams which are emitted from said laser array to scan in a main scanning direction for said one main scanning period, subsequently moves a scanning start position for a next one main scanning period by said m lines in the sub-scanning direction, and repeats said scanning and moving, when the second operational mode is set.

13. A method for forming an image, the method comprising:

emitting light from m light emitting elements in a sub-scanning direction;

outputting m lines of image data in the sub-scanning direction for one main scanning period, subsequently reading image data which is a subject of a next output with the image data shifted by n lines in the sub-scanning direction, n being a divisor of m, and repeating said outputting and reading;

driving each light emitting element so as to emit a beam, on the basis of the image data;

scanning the beams in a main scanning direction for said one main scanning period, subsequently moving a scanning start position for a next one main scanning period by said n lines in the sub-scanning direction, and repeating said scanning and moving; and scaling the intensity of light emitted by each light emitting element substantially by a ratio of n/m.

14. A method for forming an image according to claim 13, further comprising:

setting a value of said n lines for said data shifting and scanning according to an operational mode.

15. A method for forming an image according to claim 14, wherein said operational mode is an image quality mode.

16. A method for forming an image, the method comprising:

emitting light from m light emitting elements in a sub-scanning direction;

outputting m lines of image data in the sub-scanning direction for one main scanning period, subsequently reading image data which is a subject of a next output with the image data shifted by n lines in the sub-scanning direction, n being a divisor of m, and repeating said outputting and reading;

driving each light emitting element so as to emit a beam, on the basis of the image data;

scanning the beams in a main scanning direction for said one main scanning period, subsequently moving a scanning start position for a next one main scanning period by said n lines in the sub-scanning direction, and repeating said scanning and moving; and setting a value of said n lines for said data shifting and scanning according to an operational mode;

wherein said operational mode is a monochrome mode or a color mode.

17. A method for forming an image, the method comprising:

emitting light from m light emitting elements in a sub-scanning direction;

outputting m lines of image data in the sub-scanning direction for one main scanning period, subsequently reading image data which is a subject of a next output with the image data shifted by n lines in the sub-scanning direction, n being a divisor of m, and repeating said outputting and reading;

driving each light emitting element so as to emit a beam, on the basis of the image data;

scanning the beams in a main scanning direction for said one main scanning period, subsequently moving a scanning start position for a next one main scanning period by said n lines in the sub-scanning direction, and repeating said scanning and moving; and setting a first or second operational mode, wherein:

when the first operational mode is set, outputting m lines of image data in the sub-scanning direction for one main scanning period, subsequently reading image data which is a subject of a next output with the image data shifted by n lines in the sub-scanning direction, n being a divisor of m, and repeating said outputting and reading, and when the second operational mode is set, outputting 2m lines of image data for each one main scanning period; and when the first operational mode is set, scanning the beams in a main scanning direction for said one main scanning period, subsequently moving a scanning start position for a next one main scanning period by said n lines in the sub-scanning direction, and repeating said scanning and moving, and when the second operational mode is set, scanning the beams in a main scanning direction for said one main scanning period, subsequently moving a scanning start position for a next one main scanning period by said 2m lines in the sub-scanning direction, and repeating said scanning and moving.

18. A method for forming an image according to claim 17, wherein said first operational mode is a color mode, and said second operational mode is a monochrome mode.

19. A method for forming an image according to claim 17, wherein said first operational mode has a higher image quality than that of said second operational mode.

20. A method for forming an image comprising:

emitting light from 2m light emitting elements in a sub-scanning direction;

outputting 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction are switched for each one main scanning period;

driving each light emitting element so as to emit a beam, on the basis of the image data; scanning the beams in a main scanning direction for said one main scanning period, subsequently moving a scanning start position for a next one main scanning period by said m lines in the sub-scanning direction, and repeating said scanning and moving.

21. A method for forming an image according to claim 20, further comprising setting a first or second operational mode, wherein:

when the first operational mode is set, outputting 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction of said laser array are switched for each one main scanning period, and when the second operational mode is set, said data arranging unit outputs 2m lines of image data for each one main scanning period; and when the first operational mode is set, scanning the beams in a main scanning direction for said one main scanning period, subsequently moving a scanning start position for a next one main scanning period by said m lines in the sub-scanning direction, and repeating said scanning and moving, and when the second operational mode is set, scanning the beams in a main scanning direction for said one main scanning period, subsequently moving a scanning start position for a next one main scanning period by said 2m lines in the sub-scanning direction, and repeating said scanning and moving.

22. A method for forming an image according to claim 21, wherein said first operational mode is a color mode, and said second operational mode is a monochrome mode.

23. A method for forming an image according to claim 21, wherein said first operational mode has a higher image quality than that of said second operational mode.

24. A method for forming an image comprising:

setting a first or a second operational mode;

emitting light from 2m light emitting elements in a sub-scanning direction;

outputting 2m lines of image data in the sub-scanning direction for one main scanning period, subsequently shifting image data which is a subject of a next output by n lines in the sub-scanning direction, n being a divisor of 2m, and repeating said outputting and shifting, when the first operational mode is set, and outputting 2m lines of image data in which m lines of image data and m lines of dummy data are arranged in the sub-scanning direction for each one main scanning period such that lighting of odd-numbered light emitting elements and lighting of even-numbered light emitting elements in the sub-scanning direction are switched for each one main scanning period, when the second operational mode is set;

driving each light emitting element so as to emit a beam, on the basis of the image data; and scanning the beams in a main scanning direction for said one main scanning period, subsequently moving a scanning start position for a next one main scanning period by said n lines in the sub-scanning direction, and repeating said scanning and moving, when the first operational mode is set, and for scanning the beams in a main scanning direction for said one main scanning period, subsequently moving a scanning start position for a next one main scanning period by said m lines in the sub-scanning direction, and repeating said scanning and moving, when the second operational mode is set.

* * * * *